US011053745B2

(12) United States Patent
Reddy et al.

(10) Patent No.: US 11,053,745 B2
(45) Date of Patent: Jul. 6, 2021

(54) MAST AND SUBSTRUCTURE

(71) Applicant: Nabors Drilling Technologies USA, Inc., Houston, TX (US)

(72) Inventors: Padira Reddy, Richmond, TX (US); Ashish Gupta, Houston, TX (US); Ryan Hause, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 0 days.

(21) Appl. No.: 16/841,082

(22) Filed: Apr. 6, 2020

(65) Prior Publication Data

US 2020/0232284 A1 Jul. 23, 2020

Related U.S. Application Data

(63) Continuation of application No. 15/615,448, filed on Jun. 6, 2017, now Pat. No. 10,648,240.

(60) Provisional application No. 62/361,827, filed on Jul. 13, 2016.

(51) Int. Cl.

| | |
|---|---|
| ***E21B 15/00*** | (2006.01) |
| ***B66F 11/04*** | (2006.01) |
| ***E21B 7/02*** | (2006.01) |

(52) U.S. Cl.

CPC ..... *E21B 15/003* (2013.01); *B66F 11/04* (2013.01); *E21B 7/02* (2013.01); *E21B 15/00* (2013.01)

(58) Field of Classification Search

CPC ..... E21B 15/003; E21B 7/02

See application file for complete search history.

(56) References Cited

U.S. PATENT DOCUMENTS

| | | | | |
|---|---|---|---|---|
| 3,802,137 | A * | 4/1974 | Armstrong | E21B 21/00 52/118 |
| 6,848,515 | B2 * | 2/2005 | Orr | E21B 15/00 173/1 |
| 7,306,055 | B2 * | 12/2007 | Barnes | E21B 7/02 175/122 |
| 7,308,953 | B2 * | 12/2007 | Barnes | E21B 7/02 175/122 |
| 8,516,751 | B2 * | 8/2013 | Konduc | E21B 7/023 52/112 |
| 9,488,014 | B2 * | 11/2016 | Sparkman | E21B 15/006 |
| 9,739,098 | B2 * | 8/2017 | Fox | E21B 15/003 |
| 10,214,936 | B2 * | 2/2019 | Reddy | B66F 7/08 |
| 2004/0211598 | A1 * | 10/2004 | Palidis | E21B 7/02 175/162 |
| 2011/0072737 | A1 * | 3/2011 | Wasterval | E21B 7/023 52/115 |

(Continued)

FOREIGN PATENT DOCUMENTS

CN 104727745 A 6/2015

OTHER PUBLICATIONS

Office Action issued in Chinese App. No. 201780041709.8, dated Jun. 17, 2020; and English translation thereof (23 pages).

*Primary Examiner* — Steven A MacDonald
(74) *Attorney, Agent, or Firm* — Locklar PLLC

(57) ABSTRACT

A drilling rig may include a right substructure, left substructure, and a drill floor. The drill floor may be pivotably coupled to lower boxes of the left and right substructure by struts. The substructures may include hydraulic cylinders positioned to raise the drill floor and a mast coupled to the drill floor into a raised position.

13 Claims, 21 Drawing Sheets

(56) References Cited

U.S. PATENT DOCUMENTS

| | | | | |
|---|---|---|---|---|
| 2012/0167485 | A1* | 7/2012 | Trevithick | E04H 12/345 52/112 |
| 2014/0158342 | A1* | 6/2014 | Smith | B62D 57/032 166/85.1 |
| 2014/0224541 | A1* | 8/2014 | Hause | E21B 15/003 175/57 |
| 2015/0114717 | A1* | 4/2015 | Fortson | E21B 15/003 175/57 |
| 2015/0143759 | A1 | 5/2015 | Sparkman et al. | |
| 2016/0010323 | A1* | 1/2016 | Konduc | E04H 12/187 52/69 |
| 2016/0060893 | A1* | 3/2016 | Roodenburg | E04H 12/187 52/123.1 |
| 2016/0258178 | A1* | 9/2016 | Holst | E21B 15/003 |
| 2016/0312543 | A1* | 10/2016 | Cheng | E21B 15/00 |
| 2017/0081924 | A1* | 3/2017 | Smith | E21B 15/003 |

* cited by examiner

MAST AND SUBSTRUCTURE

CROSS REFERENCE TO RELATED APPLICATIONS

This application is a continuation application which claims priority from U.S. utility application Ser. No. 15/615,448, filed Jun. 6, 2017, which is itself a nonprovisional application which claims priority from U.S. provisional application No. 62/361,827, filed Jul. 13, 2016, each of which is incorporated by reference herein in its entirety.

TECHNICAL FIELD/FIELD OF THE DISCLOSURE

The present disclosure relates generally to drilling rigs, and specifically to rig structures for drilling in the petroleum exploration and production industry.

BACKGROUND OF THE DISCLOSURE

Land-based drilling rigs may be configured to be traveled to different locations to drill multiple wells within the same area, traditionally known as a wellsite. In certain situations, the land-based drilling rigs may travel across an already drilled well for which there is a well-head in place. Further, mast placement on land-drilling rigs may have an effect on drilling activity. For example, depending on mast placement on the drilling rig, an existing well-head may interfere with the location of land-situated equipment such as, for instance, existing wellheads, and may also interfere with raising and lowering of equipment needed for operations.

SUMMARY

The present disclosure provides for a drilling rig. The drilling rig may include a right substructure. The right substructure may include a first lower box, at least one strut pivotably coupled to the first lower box, and a first hydraulic cylinder pivotably coupled to the first lower box. The drilling rig may include a left substructure. The left substructure may include a second lower box, at least one strut pivotably coupled to the second lower box, and a second hydraulic cylinder pivotably coupled to the second lower box. The drilling rig may include a drill rig floor mechanically coupled to the struts of the right and left substructures. The drilling rig may include a mast, the mast being mechanically coupled to the drill floor. The first and second hydraulic cylinders are adapted to raise or lower the drill floor and the mast.

The present disclosure also provides for a method. The method may include transporting a drilling rig to a wellsite. The drilling rig may include a right substructure. The right substructure may include a first lower box, at least one strut pivotably coupled to the first lower box, and a first hydraulic cylinder pivotably coupled to the first lower box. The drilling rig may include a left substructure. The left substructure may include a second lower box, at least one strut pivotably coupled to the second lower box, and a second hydraulic cylinder pivotably coupled to the second lower box. The drilling rig may include a drill rig floor mechanically coupled to the struts of the right and left substructures. The method may include mechanically coupling a mast to the drill rig floor. The mast may be pivotably coupled to one or more mast pivot points of the drill rig floor in a horizontal position. The method may include mechanically coupling a distal end of the first hydraulic cylinder and a distal end of the second hydraulic cylinder to one or more corresponding mast lift points of the mast. The method may include extending the hydraulic cylinders to move the mast from the horizontal position to a vertical position. The method may include mechanically coupling the distal ends of the first and second hydraulic cylinders to one or more corresponding rig lift points of the drill rig floor. The method may include extending the hydraulic cylinders to move the drill rig floor from a lowered position to a raised position.

The present disclosure also provides for a method. The method includes transporting a drilling rig to a wellsite. The drill rig includes a right substructure, the right substructure including a first lower box, with at least one strut pivotably coupled to the first lower box. The drill rig also includes a left substructure, the left substructure including a second lower box, with at least one strut pivotably coupled to the second lower box. The drill rig also includes a drill rig floor, the drill rig floor mechanically coupled to the struts of the right and left substructures. The method also includes mechanically coupling a mast to the drill rig floor, the mast pivotably coupled to one or more mast pivot points of the drill rig floor, and the mast is in a horizontal position. The method also includes positioning a hydraulic cylinder skid. The hydraulic cylinder skid includes a skid frame, the skid frame having a rig attachment point, and one or more raising cylinders, the one or more raising cylinders pivotably coupled to the skid frame. The hydraulic cylinder also includes a hydraulic power unit, the hydraulic power unit mechanically coupled to the skid frame and operatively coupled to the one or more raising cylinders. In addition, the method includes mechanically coupling the skid frame to the drilling rig at the rig attachment point and mechanically coupling the one or more raising cylinders to one or more corresponding mast lift points of the mast. The method also includes extending the one or more raising cylinders to move the mast from the horizontal position to a vertical position and mechanically coupling the one or more raising cylinders to one or more corresponding rig lift points of the drill rig floor. The method further includes extending the raising cylinders to move the drill rig floor from a lowered position to a raised position.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
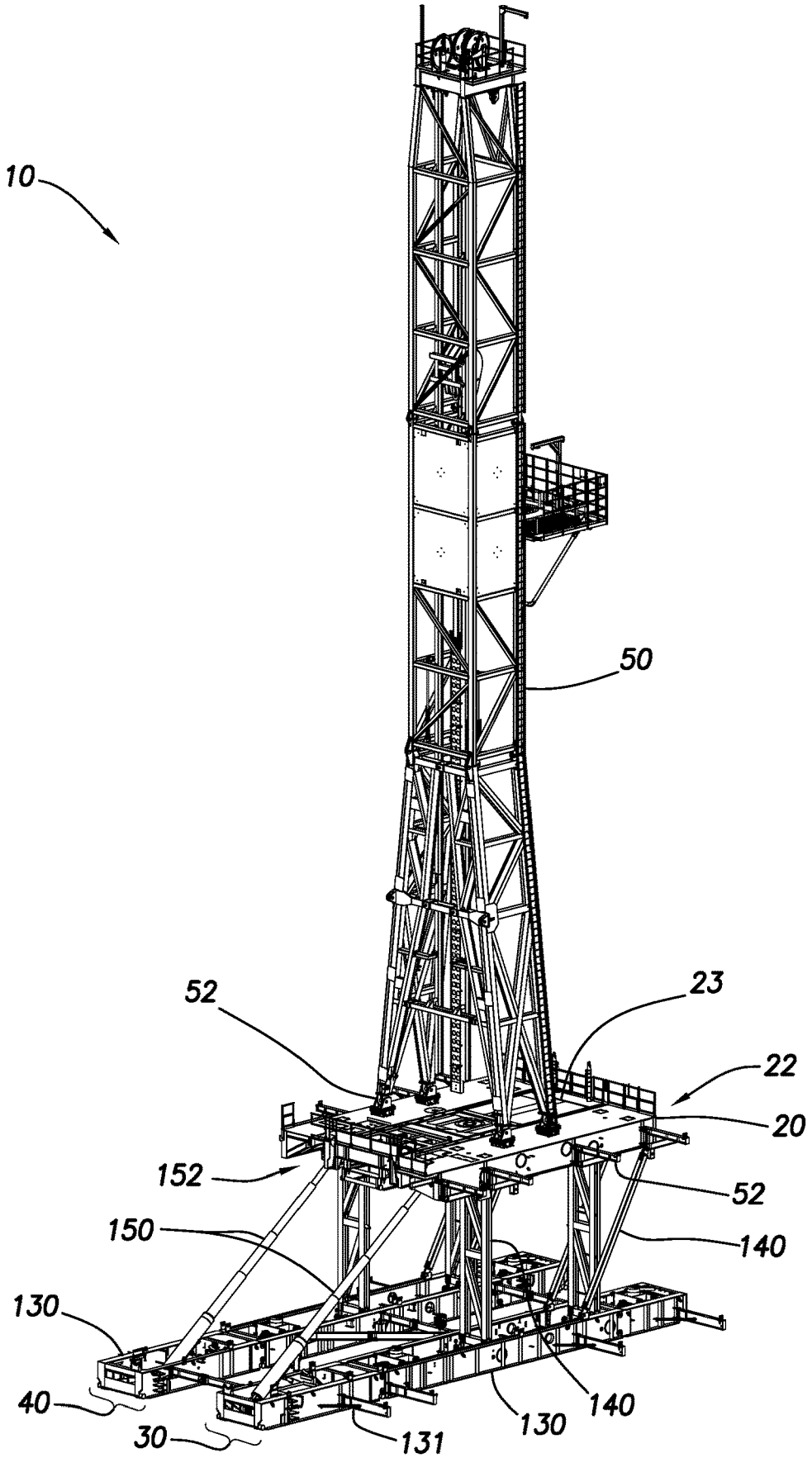
FIG. 1 depicts a perspective view of a drilling rig consistent with at least one embodiment of the present disclosure in a raised position.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts a perspective view of drilling rig 10 in a raised position. In some embodiments, drilling rig 10 may include drill rig floor 20, right substructure 30, left substructure 40, and mast 50. Right substructure 30 and left substructure 40 may support drill rig floor 20. Right and left substructures 30, 40 may be generally parallel and spaced apart in the right-left direction. As would be understood by one having ordinary skill in the art with the benefit of this disclosure, the terms "right" and "left" as used herein are only used to refer to each separate substructure to simplify discussion, and are not intended to limit this disclosure in any way. Right and left substructures 30, 40, may each include one or more lower boxes 130 and one or more struts 140. Each lower box 130 may be formed as a single unit or may be formed from one or more mechanically coupled subcomponents. Drill rig floor 20 may be mechanically coupled to lower boxes 130 by struts 140. Struts 140 may be pivotably coupled to drill rig floor 20 and to one or more lower boxes 130. Lower boxes 130 may be generally parallel to each other and spaced apart in the left-right direction. In some embodiments, struts 140 may be coupled to drill rig floor 20 and lower boxes 130 such that struts 140 form a bar linkage between lower boxes 130 and drill rig floor 20, allowing motion of drill rig floor 20 relative to lower boxes 130 while maintaining drill rig floor 20 parallel to lower boxes 130 as further discussed hereinbelow. In some embodiments, right substructure 30 may include a lower box 130 referred to herein as a right lower box. In some embodiments, left substructure 40 may include a lower box 130 referred to herein as a left lower box.

Figure 1A:
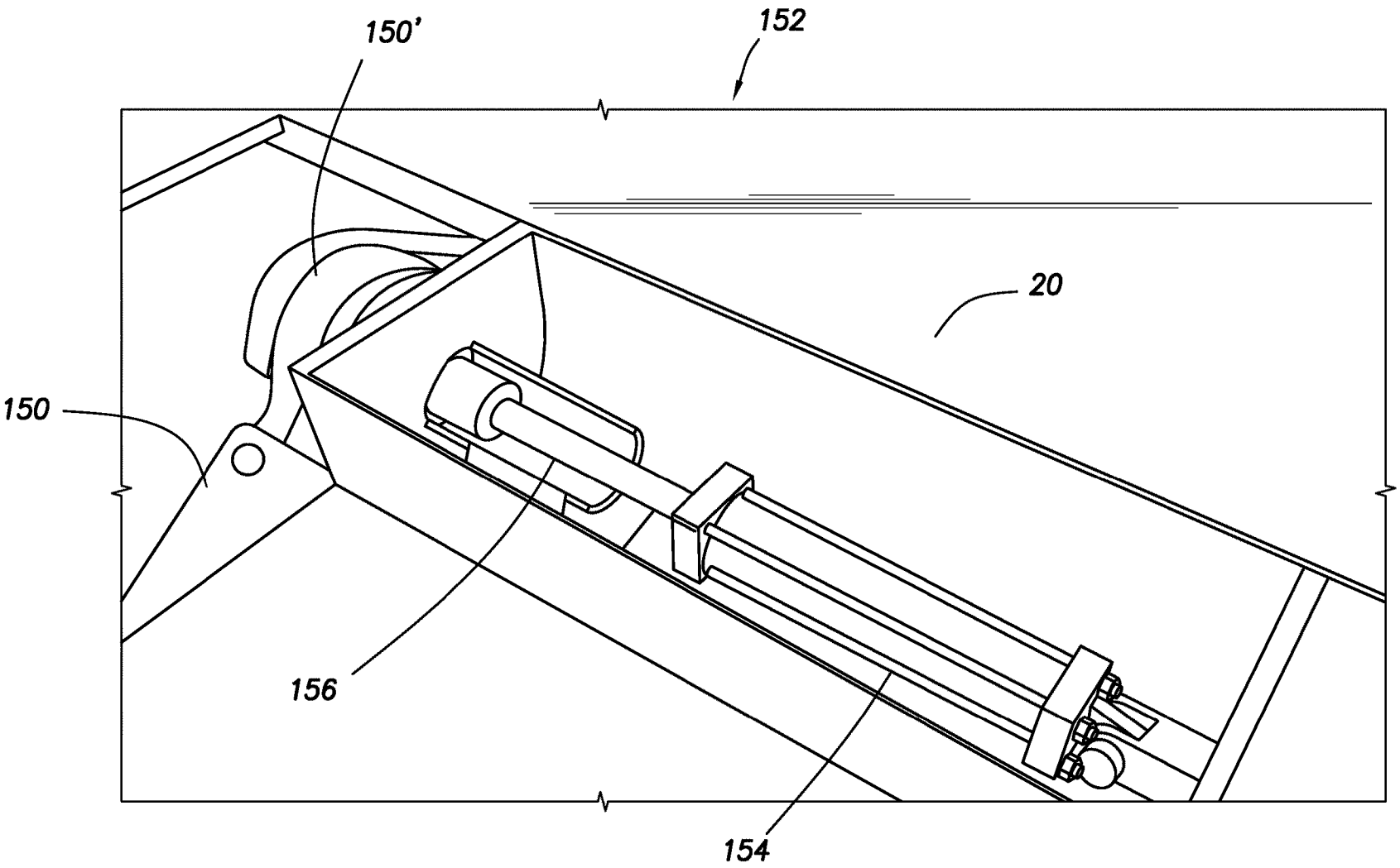
FIG. 1A depicts a perspective view of a rig lift point of a drilling rig consistent with at least one embodiment of the present disclosure.
Figure 2:
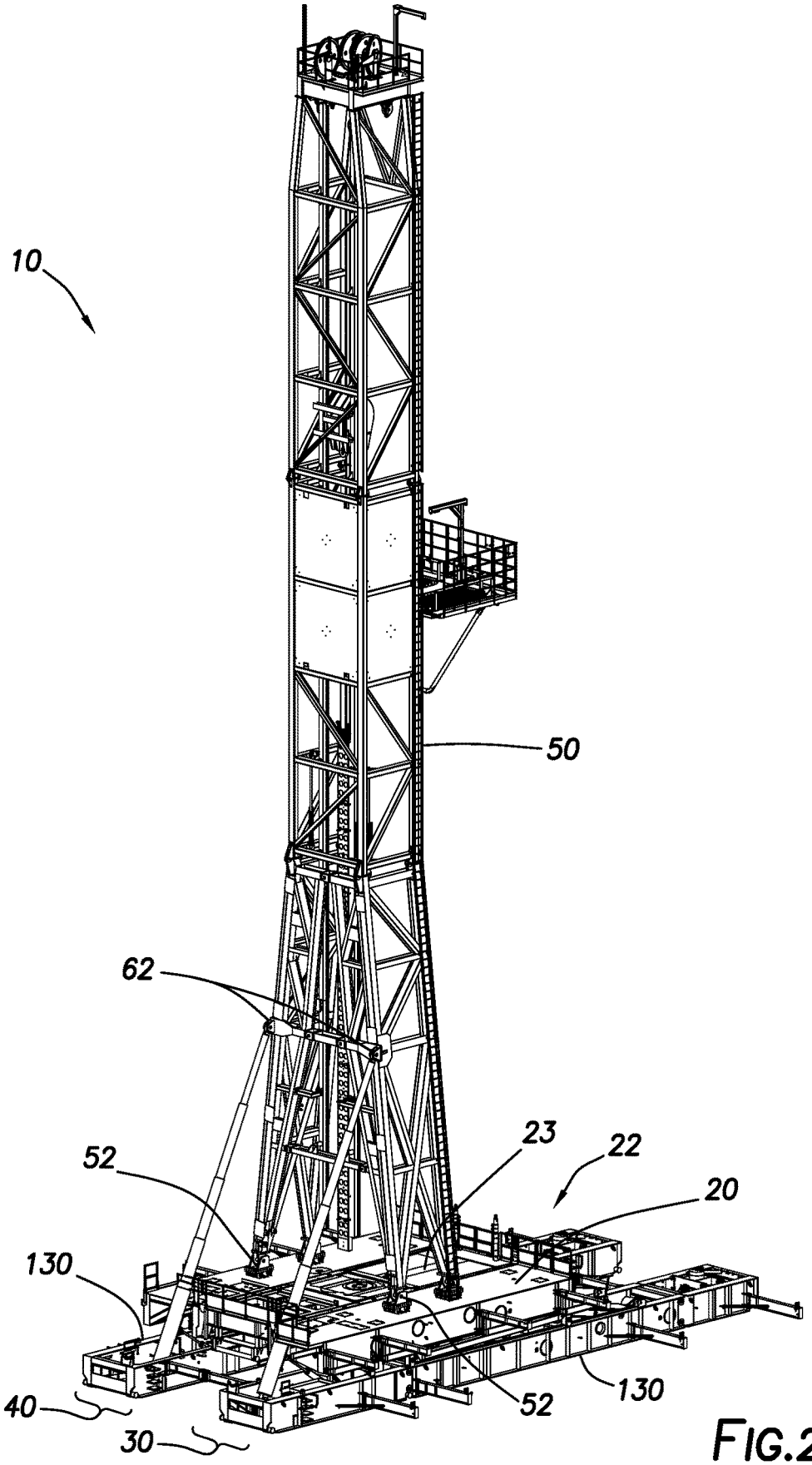
FIG. 2 depicts the drilling rig of FIG. 1 with the drill rig floor in a lowered position.

In some embodiments, drill rig floor 20 may be movable from a raised position as depicted in FIG. 1 to a lowered position as depicted in FIG. 2 by pivoting movement of struts 140. In some embodiments, drill rig floor 20 may be movable between the raised position and the lowered position by one or more hydraulic cylinders 150. In some embodiments, hydraulic cylinders 150, shown in FIG. 1 mechanically coupled to drill rig floor 20, may be mechanically and pivotably coupled to lower boxes 130. In some embodiments, hydraulic cylinders 150 may mechanically couple to one or more corresponding rig lift points 152 of drill rig floor 20. In some embodiments, each rig lift point 152 may include one or more members such as bars to which hydraulic cylinders 150 may mechanically couple. In some embodiments, as depicted in FIG. 1A, each rig lift point 152 may include attachment point hydraulic ram 154. Attachment point hydraulic ram 154 may extend or retract attachment bar 156. Attachment bar 156 may, when extended, engage distal end 150' of hydraulic cylinder 150, mechanically coupling hydraulic cylinder 150 to drill rig floor 20. In some embodiments, when hydraulic cylinder 150 is mechanically coupled to drill rig floor 20, extension or retraction of hydraulic cylinder 150 may move drill rig floor 20 toward the raised position as depicted in FIG. 1 or lowered position as depicted in FIG. 2 respectively.

In some embodiments, drill rig floor 20 may include V-door 23. In some embodiments, hydraulic cylinders 150 may be positioned in lower boxes 130 such that hydraulic cylinders 150 mechanically couple to a side of drill rig floor 20 that is opposite the side of drill rig floor 20 that includes V-door 23, defined as V-door side 22 of drill rig floor 20.

Figure 2A:
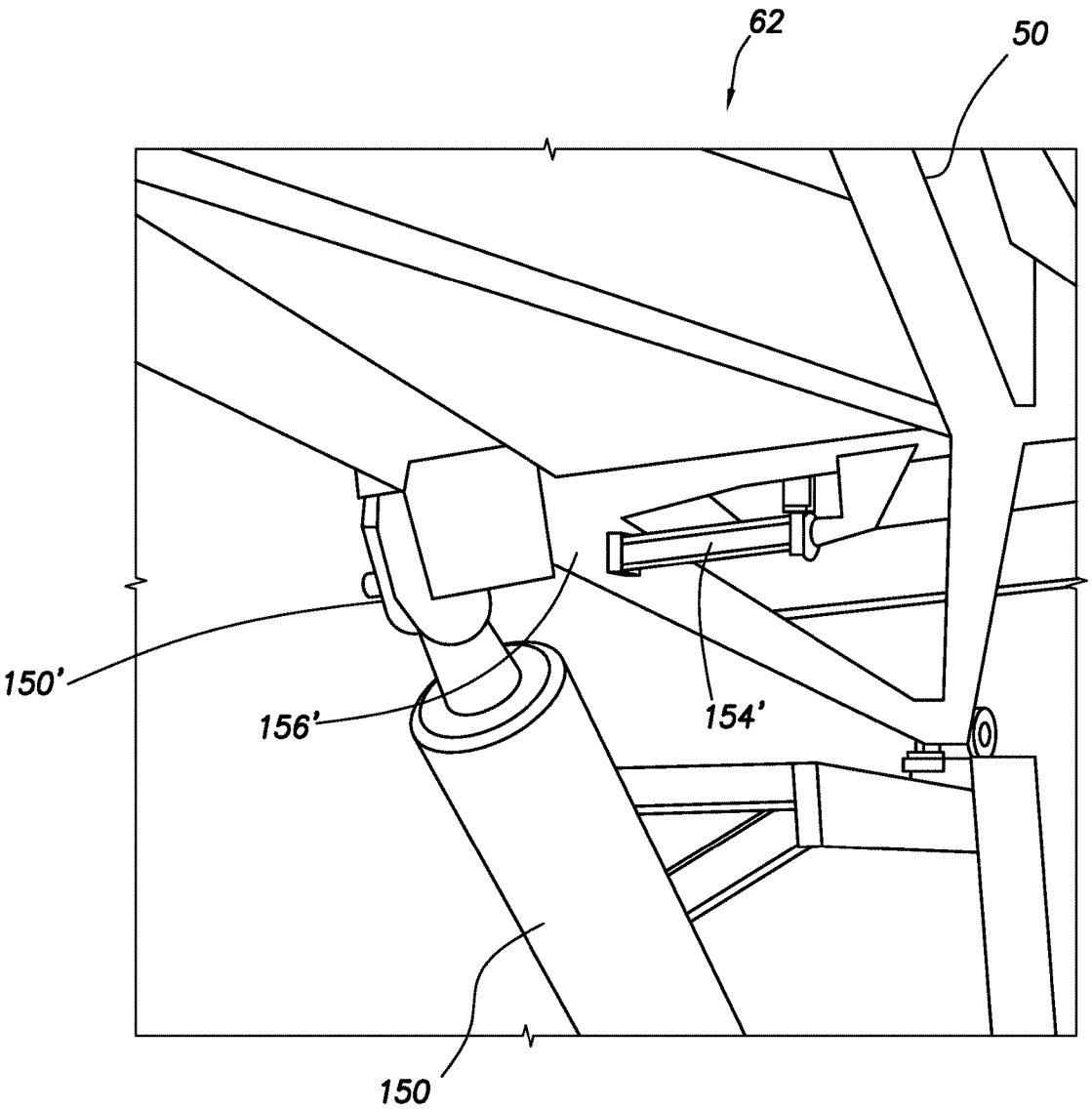
FIG. 2A depicts a perspective view of a mast lift point of a drilling rig consistent with at least one embodiment of the present disclosure.
Figure 3:
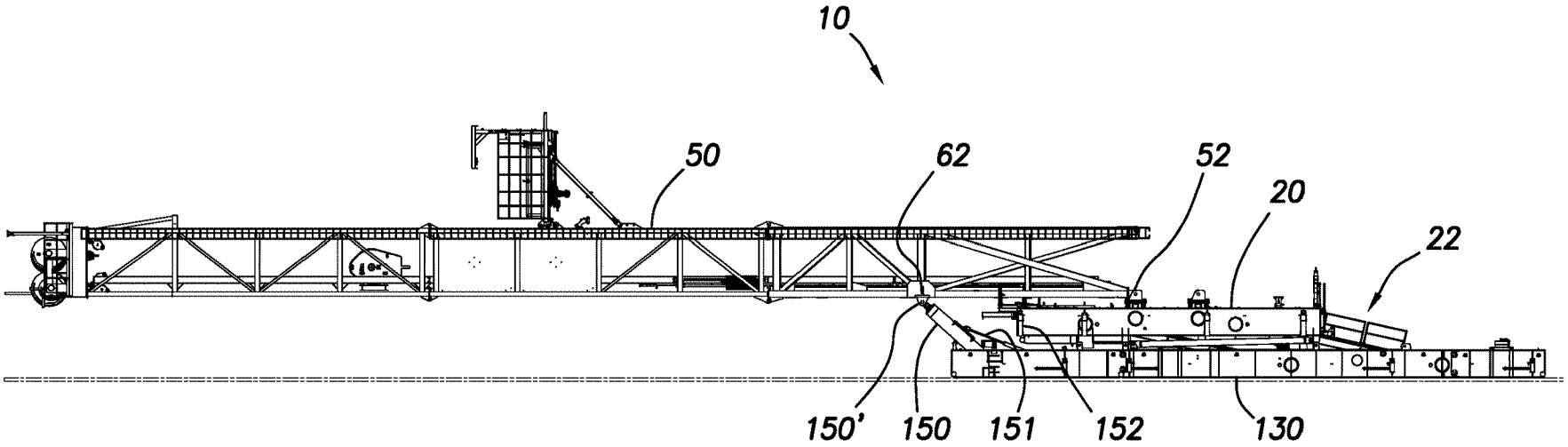
FIG. 3 depicts the drilling rig of FIG. 1 with the mast in a lowered position.

In some embodiments, mast 50 may be pivotably coupled to drill rig floor 20 by one or more mast pivot points 52. In some embodiments, mast pivot points 52 may be positioned on drill rig floor 20 such that mast 50 may pivot from a mast raised position as depicted in FIG. 2 to a mast lowered position as depicted in FIG. 3. In some such embodiments, mast 50 may pivot in a direction away from V-door side 22 of drill rig floor 20 when mast 50 is lowered. In some embodiments, hydraulic cylinders 150 may be used to move mast 50 from the raised position to the lowered position. In some such embodiments, hydraulic cylinders 150, as shown in FIG. 2, may mechanically couple to one or more mast lift points 62. In some embodiments, each mast lift point 62 may include one or more members such as bars to which distal end 150' of hydraulic cylinders 150 may mechanically couple. In some embodiments, as depicted in FIG. 2A, each mast lift point 62 may include mast attachment point hydraulic ram 154'. Mast attachment point hydraulic ram 154' may extend or retract mast attachment bar 156'. Mast attachment bar 156' may, when extended, engage distal end 150' of hydraulic cylinder 150, mechanically coupling hydraulic cylinder 150 to mast 50.

In some embodiments, each hydraulic cylinder 150 may be extended or retracted by hydraulic pressure. In some embodiments, each hydraulic cylinder 150 may, when detached from rig lift points 152 and mast lift points 62, be pivoted relative to the respective lower box 130 by one or more cylinder positioning hydraulic cylinders 151 as shown in FIG. 3. Cylinder positioning hydraulic cylinder 151 may, for example and without limitation, raise distal end 150' of hydraulic cylinder 151 relative to lower box 130. By modulating the extension of hydraulic cylinders 150 and cylinder positioning hydraulic cylinders 151, distal end 150' of hydraulic cylinders 150 may be positioned in space to, for example and without limitation, align with rig lift points 152, mast lift points 62, or any other desired position.

Figure 4:
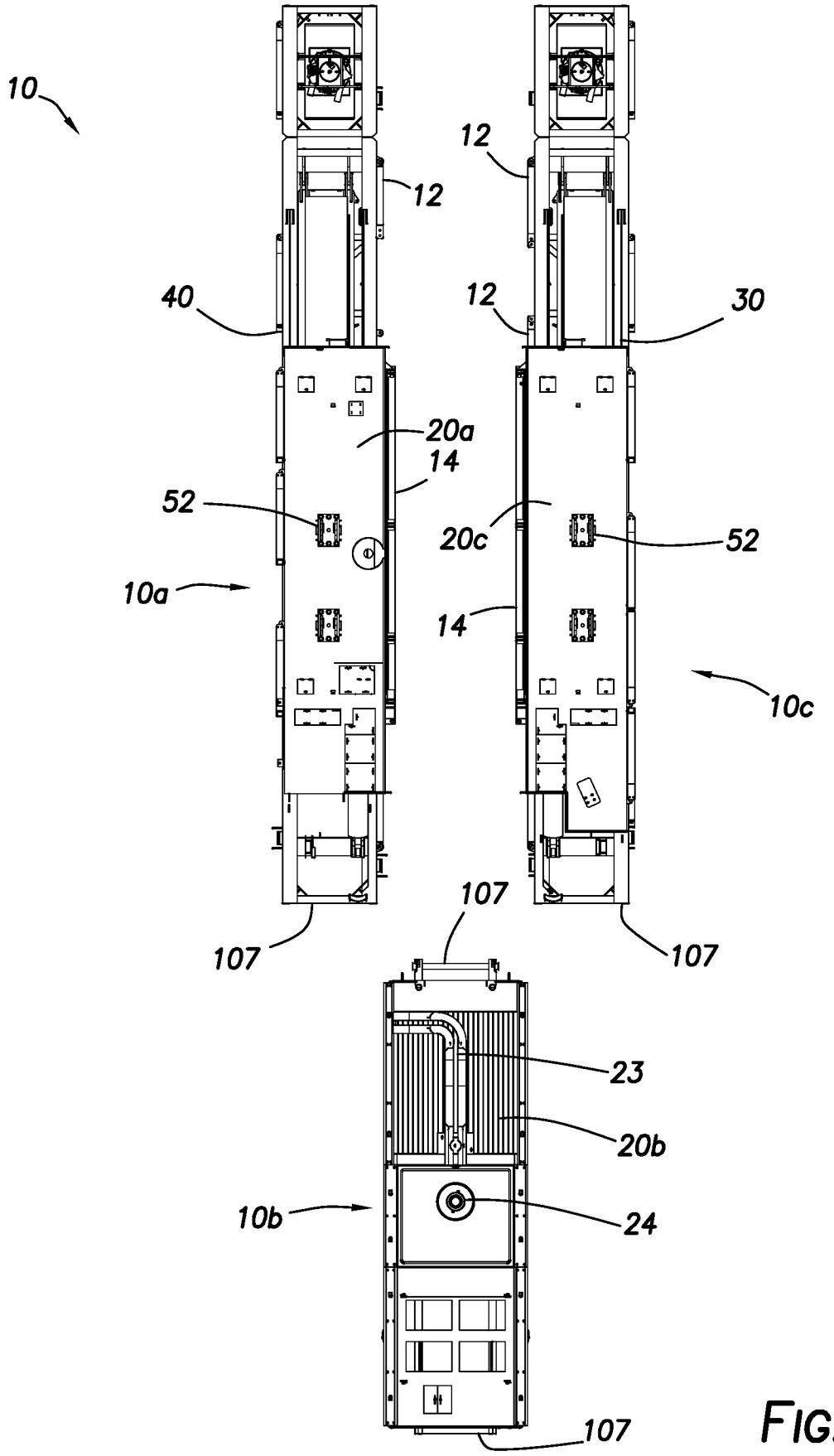
FIG. 4 depicts a top view of a disassembled drilling rig consistent with at least one embodiment of the present disclosure.

In some embodiments, drilling rig 10 may be formed from multiple subunits. For example and without limitation, in some embodiments as depicted in FIG. 4, drilling rig 10 may be separable into three drilling rig subunits: left drilling rig subunit 10*a*, center drilling rig subunit 10*b*, and right drilling rig subunit 10*c*. In some embodiments, drill rig floor 20 may be separable into three corresponding rig floor subunits: left rig floor subunit 20*a*, center rig floor subunit 20*b*, and right rig floor subunit 20*c*. Each drilling rig subunit 10*a-c* may include a corresponding rig floor subunit 20*a-c*. In some embodiments, left drilling rig subunit 10*a* may include left substructure 40. In some embodiments, right drilling rig subunit 10*c* may include right substructure 30. In some embodiments, center rig floor subunit 20*b* may include V-door 23 and rotary table 24. In some embodiments, left rig floor subunit 20*a* and right rig floor subunit 20*c* may include mast pivot points 52.

When drilling rig 10 is transported, each drilling rig subunit 10*a-c* may be transported separately. In some embodiments, each drilling rig subunit 10*a-c* may be sized such that each drilling rig subunit 10*a-c* complies with one or more transportation regulations. In some embodiments, one or more of drilling rig subunits 10*a-c* may include tail rolls 107. Tail rolls 107 may be one or more bars or other mounting points for allowing each drilling rig subunit 10*a-c* to be loaded onto a winch truck. In some embodiments, one or more of drilling rig subunits 10*a-c* may include one or more D-rings (not shown) to, for example and without limitation, allow the attachment of winch lines to move drilling rig subunits 10*a-c*.

Figure 5:
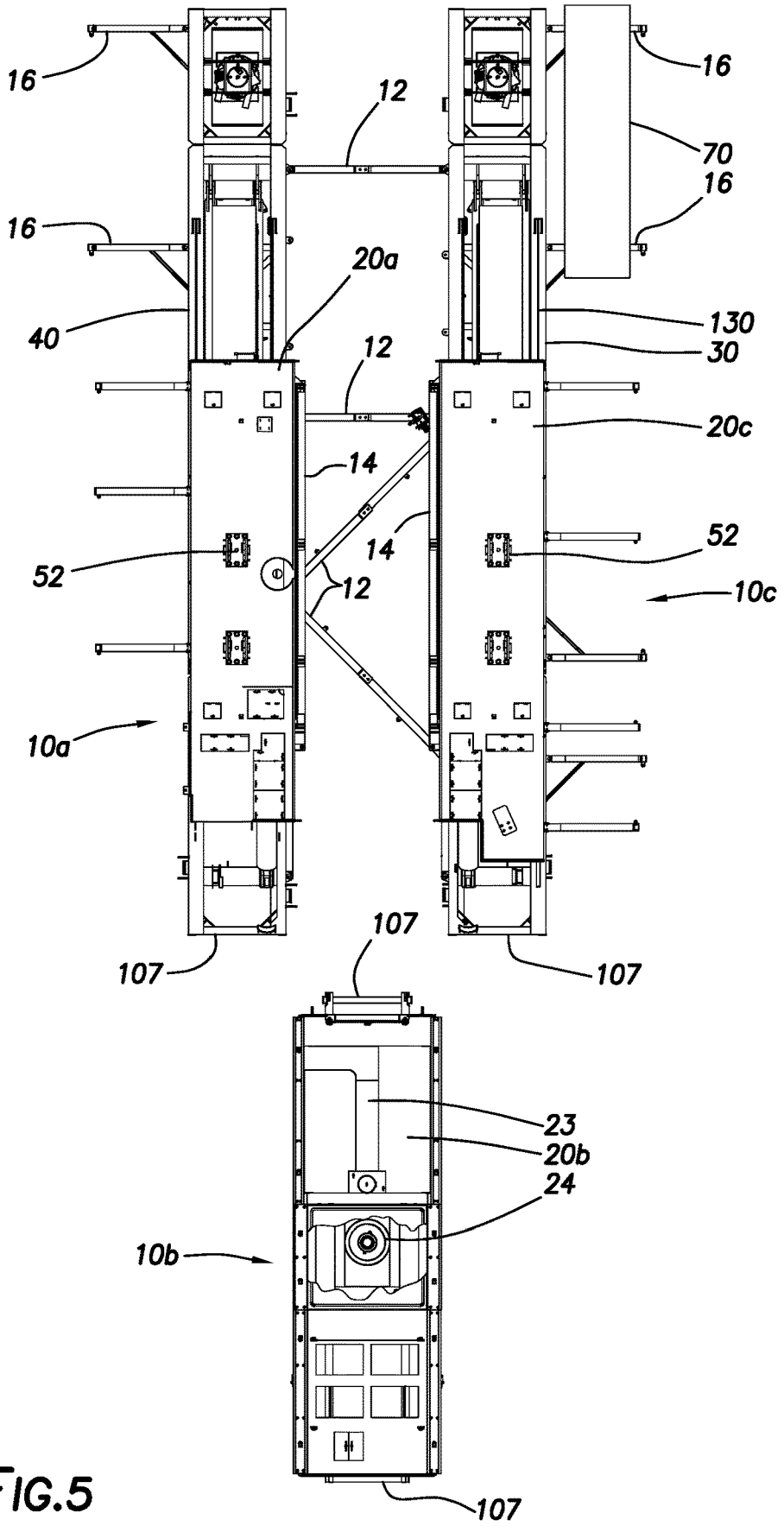
FIG. 5 depicts a top view of a partially disassembled drilling rig consistent with at least one embodiment of the present disclosure.

In some embodiments, to assembly drilling rig 10, left drilling rig subunit 10*a*, center drilling rig subunit 10*b*, and right drilling rig subunit 10*c* may be transported to the drill site. Left drilling rig subunit 10*a* and right drilling rig subunit 10*c* may be positioned substantially parallel and spaced apart as depicted in FIG. 4. As shown in FIG. 5, in some embodiments, one or more cross braces 12 may be extended between left drilling rig subunit 10*a* and right drilling rig subunit 10*c*. In some embodiments, each cross brace 12 may be pivotably coupled to one of left drilling rig subunit 10*a* or right drilling rig subunit 10*c*. During transportation as depicted in FIG. 4, cross braces 12 may be pivoted to be close to lower box 130 of the respective drilling rig subunit 10*a* or 10*c*.

When drilling rig 10 is to be assembled and drilling rig subunits 10*a* and 10*c* are positioned in the drill site, cross braces 12 may be pivoted outward and may be mechanically coupled to the other drilling rig subunit 10*c* or 10*a* as depicted in FIG. 5. Cross braces 12 may mechanically couple drilling rig subunits 10*a* and 10*c*.

Figure 6A:
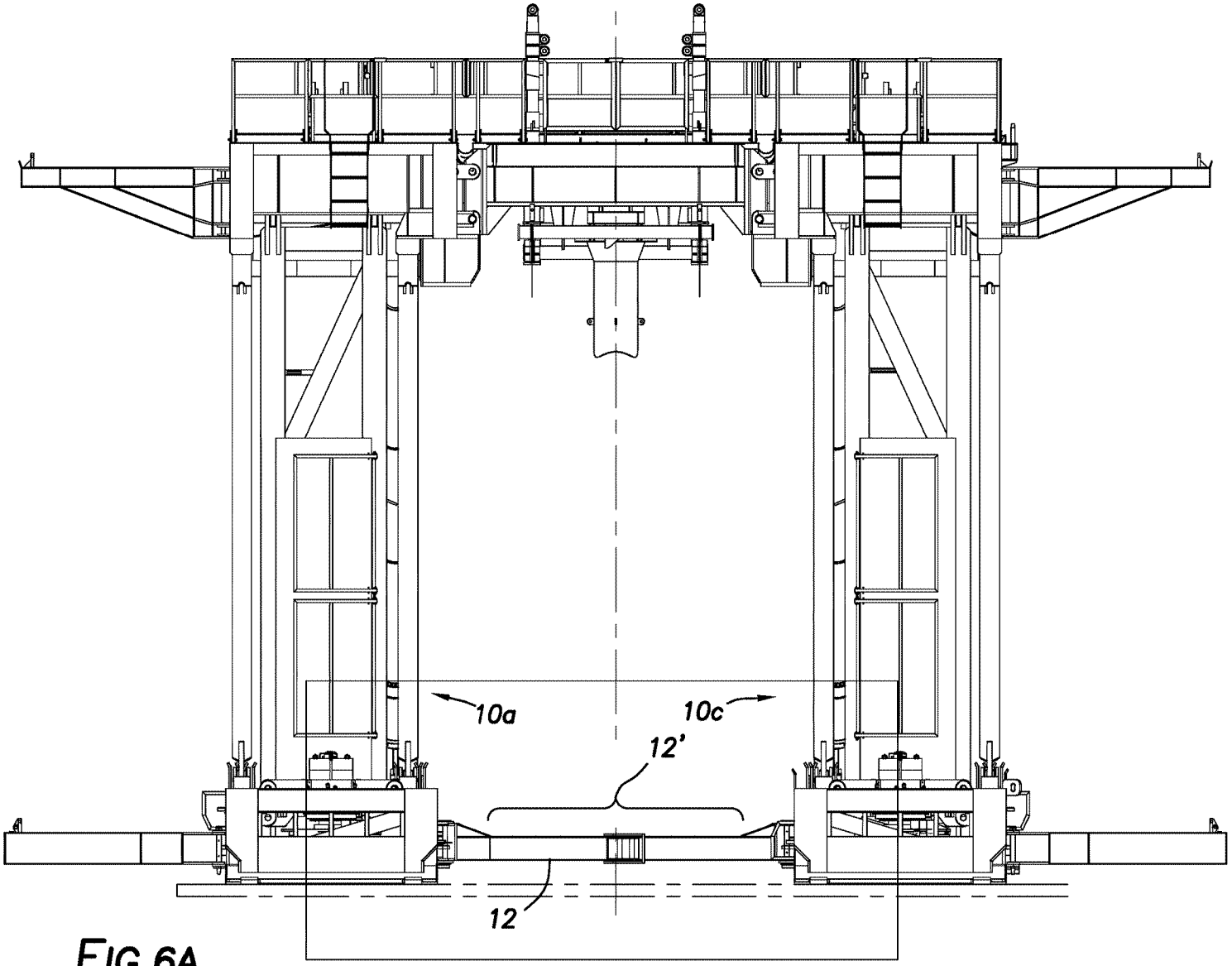
FIGS. 6A and 6B depict elevation views of cross braces consistent with at least one embodiment of the present disclosure.
Figure 6B:
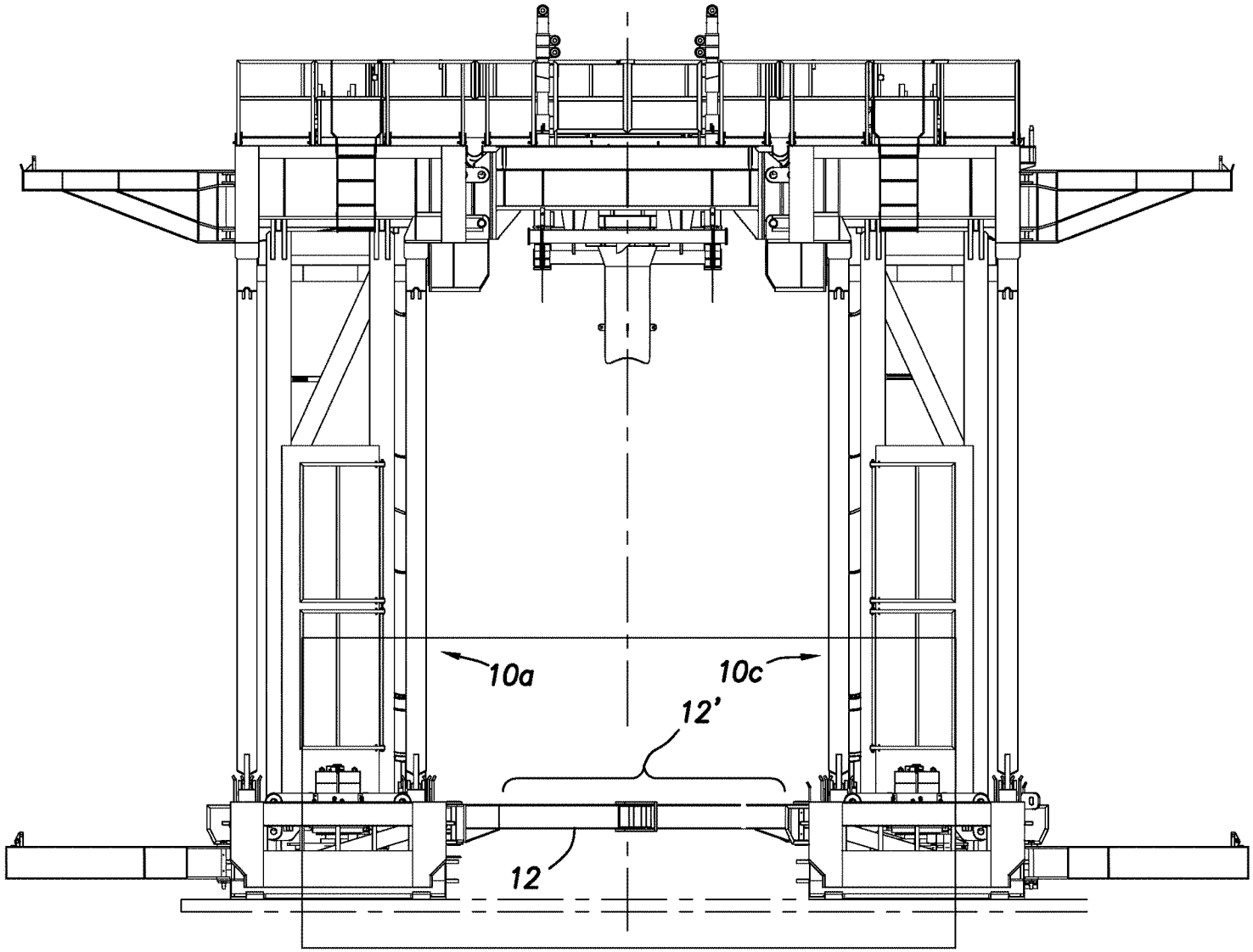

In some embodiments, cross braces 12 may be formed as extended beams. In some embodiments, each cross brace 12 may include one or more subunits which may be mechanically coupled to a respective drilling rig subunit 10*a* or 10*c* and may me mechanically coupled in the middle of cross brace 12. In some embodiments, cross braces 12 may be narrower in height toward a middle of the respective cross brace 12, defined as narrowed portion 12'. In some such embodiments, cross brace 12 may be selectively decoupleable from drilling rig subunits 10*a* and 10*c* and may be repositioned. For example and without limitation, as depicted in FIG. 6A, cross brace 12 may be positionable such that the distance between the top of cross brace 12 and a surface such as the ground is reduced by positioning narrowed portion 12' of cross brace 12 in a lower position. In the reversed position as depicted in FIG. 6B, the clearance between the ground and cross brace 12 may be increased by positioning narrowed portion 12' of cross brace 12 in a higher position.

Figure 7:
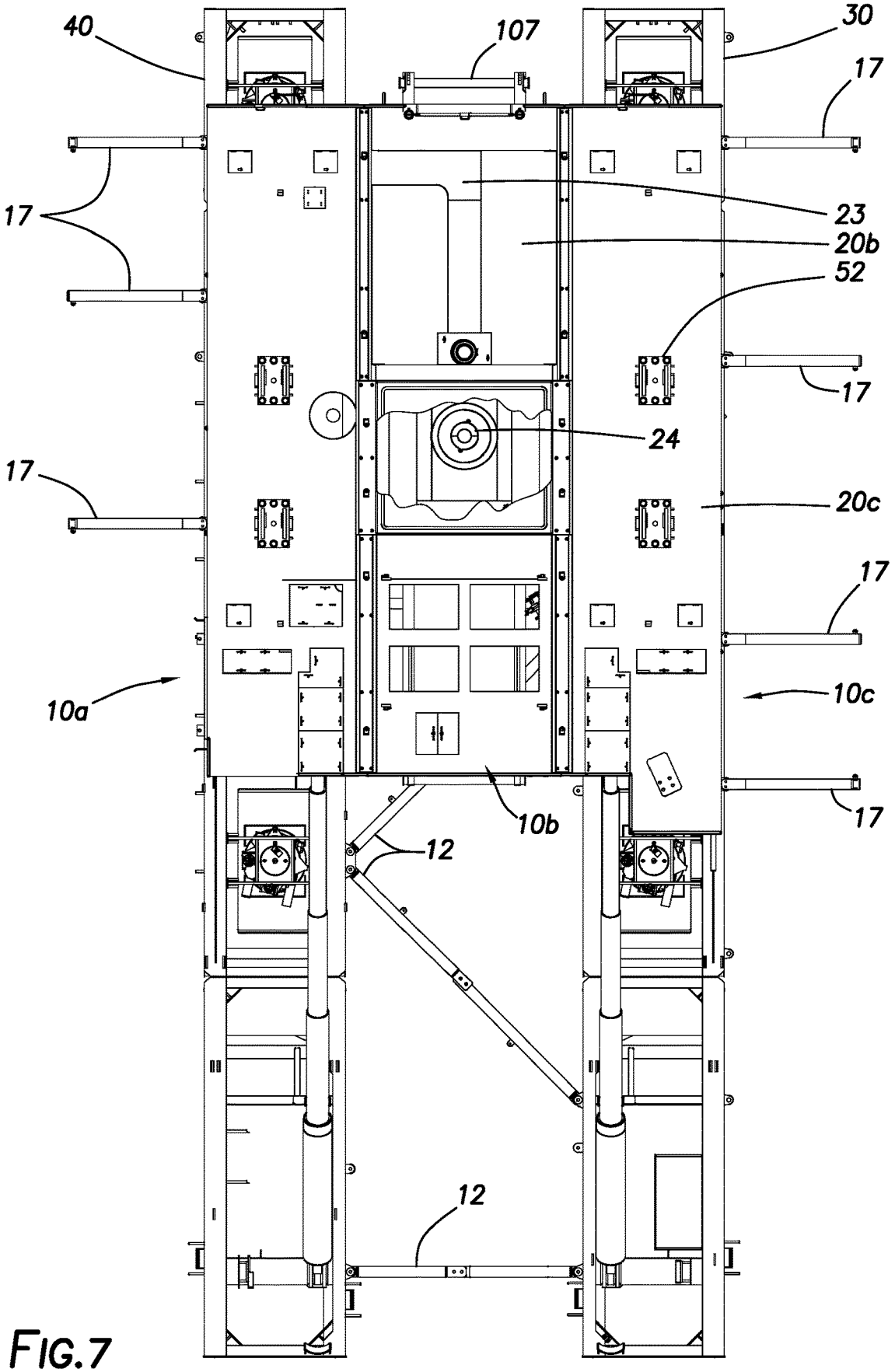
FIG. 7 depicts a top view of a partially disassembled drilling rig consistent with at least one embodiment of the present disclosure.

When left and right drilling rig subunits 10*a*, 10*c* are mechanically coupled, center drilling rig subunit 10*b* may be positioned between left drilling rig subunit 10*a* and right drilling rig subunit 10*c* as depicted in FIG. 7. Center drilling rig subunit 10*b* may mechanically couple to each of left drilling rig subunit 10*a* and right drilling rig subunit 10*c*. In some embodiments, left drilling rig subunit 10*a* and right drilling rig subunit 10*c* may include one or more supports 14 as shown in FIG. 5 positioned to support center drilling rig subunit 10*b*.

In some embodiments, as depicted in FIG. 5, one or both of left and right drilling rig subunits 10*a*, 10*c* may include one or more equipment support cantilever beams 16. Equipment support cantilever beams 16 may be pivotably coupled to a respective lower box 130 of drilling rig subunit 10*a* or 10*c*. In some embodiments, equipment support cantilever beams 16 may be pivoted to be close to lower box 130 of the respective drilling rig subunit 10*a* or 10*c*. Equipment support cantilever beams 16 may, when extended as depicted in FIG. 5, be used to support one or more pieces of drilling rig equipment, including, for example and without limitation, hydraulic pressure unit skid 70. Hydraulic pressure unit skid 70 may be positioned atop one or more equipment support cantilever beams 16. In some embodiments, one or more of a hoist skid, drill line spooler skid, mud gas separator skid, stair tower, accumulator skid, hydraulic pressure unit skid, mud tank skid, generator skid, or any other piece of rig equipment may be positioned atop and mechanically coupled to one or more equipment support cantilever beams 16. In some embodiments, hydraulic pressure unit skid 70 may provide hydraulic power to hydraulic cylinders 150 as previously described. In some embodiments, hydraulic pressure unit skid 70 may couple to one or more hydraulic lines built into one or more of drilling rig subunits 10*a-c* and may provide hydraulic power to drilling rig 10 therethrough.

Figure 8:
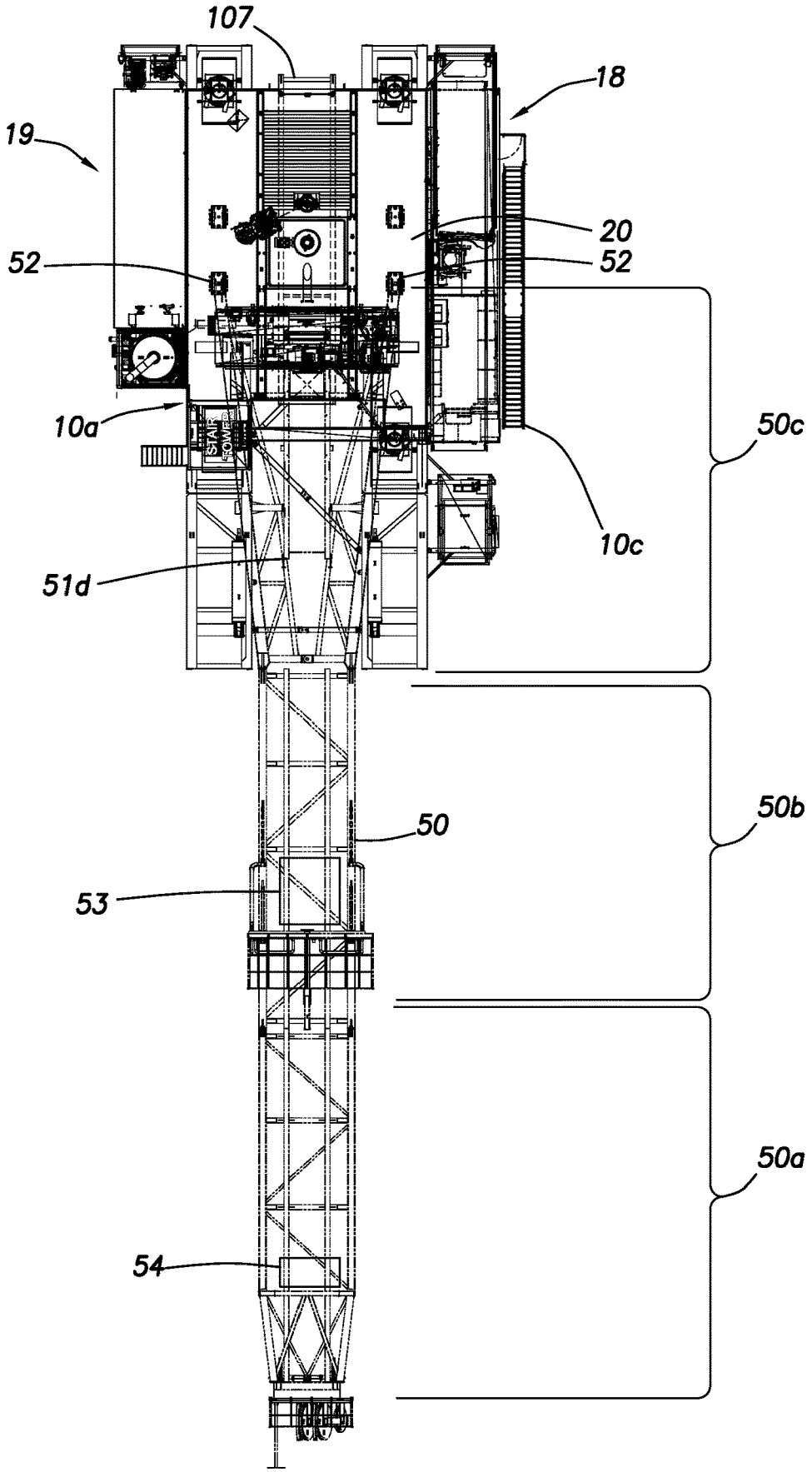
FIG. 8 depicts a top view of a partially disassembled drilling rig consistent with at least one embodiment of the present disclosure.

In some embodiments, once left, center, and right drilling rig subcomponents 10*a*-10*c* are mechanically coupled, mast 50 may be moved and mechanically coupled to drill rig floor 20 at mast pivot points 52 as depicted in FIG. 8. Mast 50 may be transported in a horizontal position. In some embodiments, mast 50 may be transported in a horizontal position such that the open side of mast 50, defining a mast V-door side, is at the top of mast 50 in the horizontal position.

In some embodiments, as depicted in FIG. 8 and FIGS. 9A-9D, mast 50 may include one or more mast subcomponents, here depicted as upper mast subcomponent 50*a*, middle mast subcomponent 50*b*, and lower mast subcomponent 50*c*. In some embodiments, mast subcomponents

50*a*-50*c* may be mechanically coupled in the horizontal position before installation to drill rig floor 20. In some embodiments, top drive 53 and traveling block 54 may be transported within mast 50 when in the horizontal position without additional bracing. In some embodiments, traveling block 54 may be positioned within upper mast subcomponent 50*a* and top drive 53 may be positioned within middle mast subcomponent 50*b* during transportation. In some embodiments, during a mast lifting operation as previously described, traveling block 54 and top drive 53 may be positioned within upper mast subcomponent 50*a*. In some embodiments, traveling block 54 and top drive 53 may be positioned within middle mast subcomponent 50*b* during a mast lift operation. In some embodiments, traveling block 54 may be strung up during transportation.

Figure 9A:
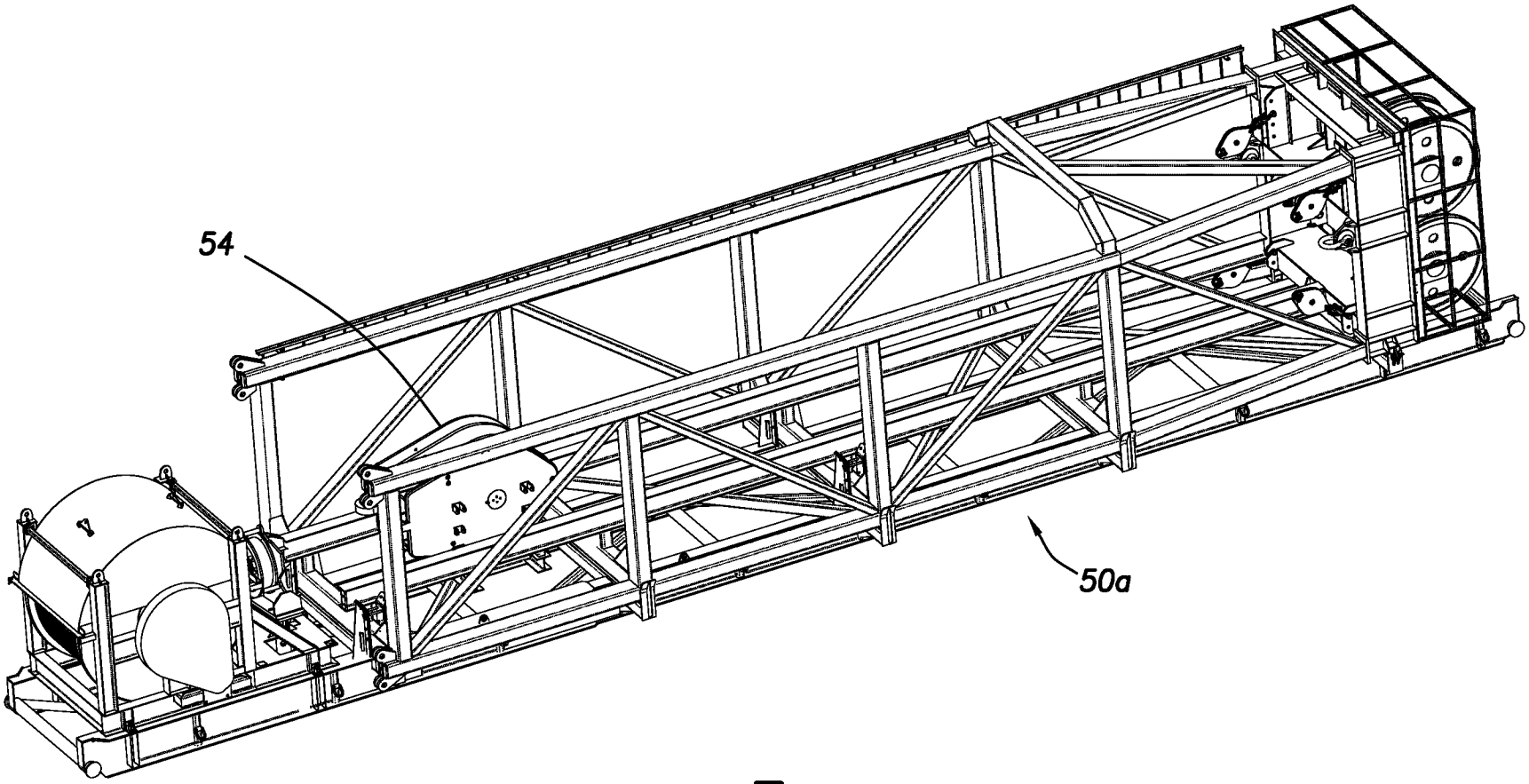
FIG. 9A depicts a perspective view of an upper mast subcomponent consistent with at least one embodiment of the present disclosure.
Figure 9B:
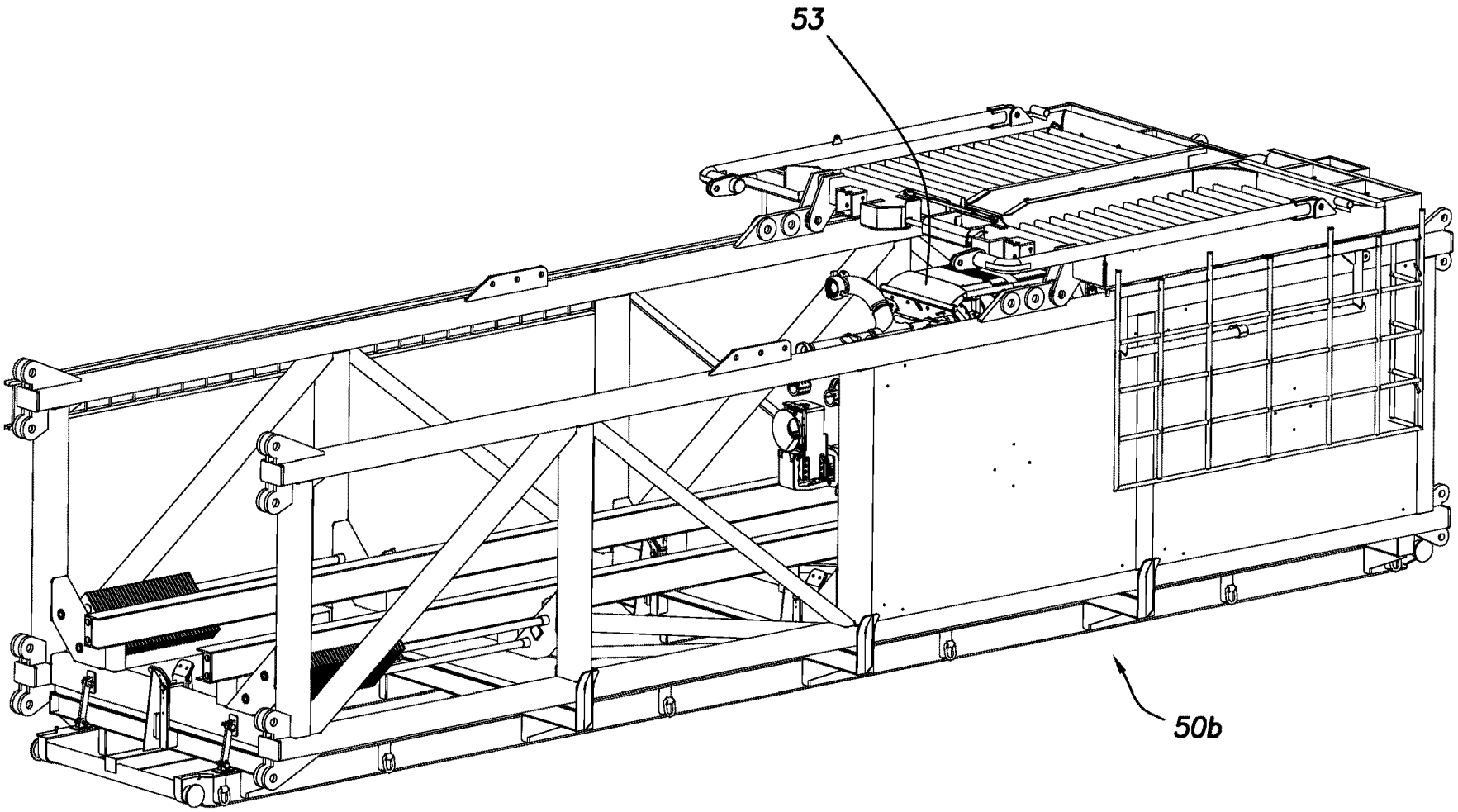
FIG. 9B depicts a perspective view of a middle mast subcomponent consistent with at least one embodiment of the present disclosure.
Figure 9C:
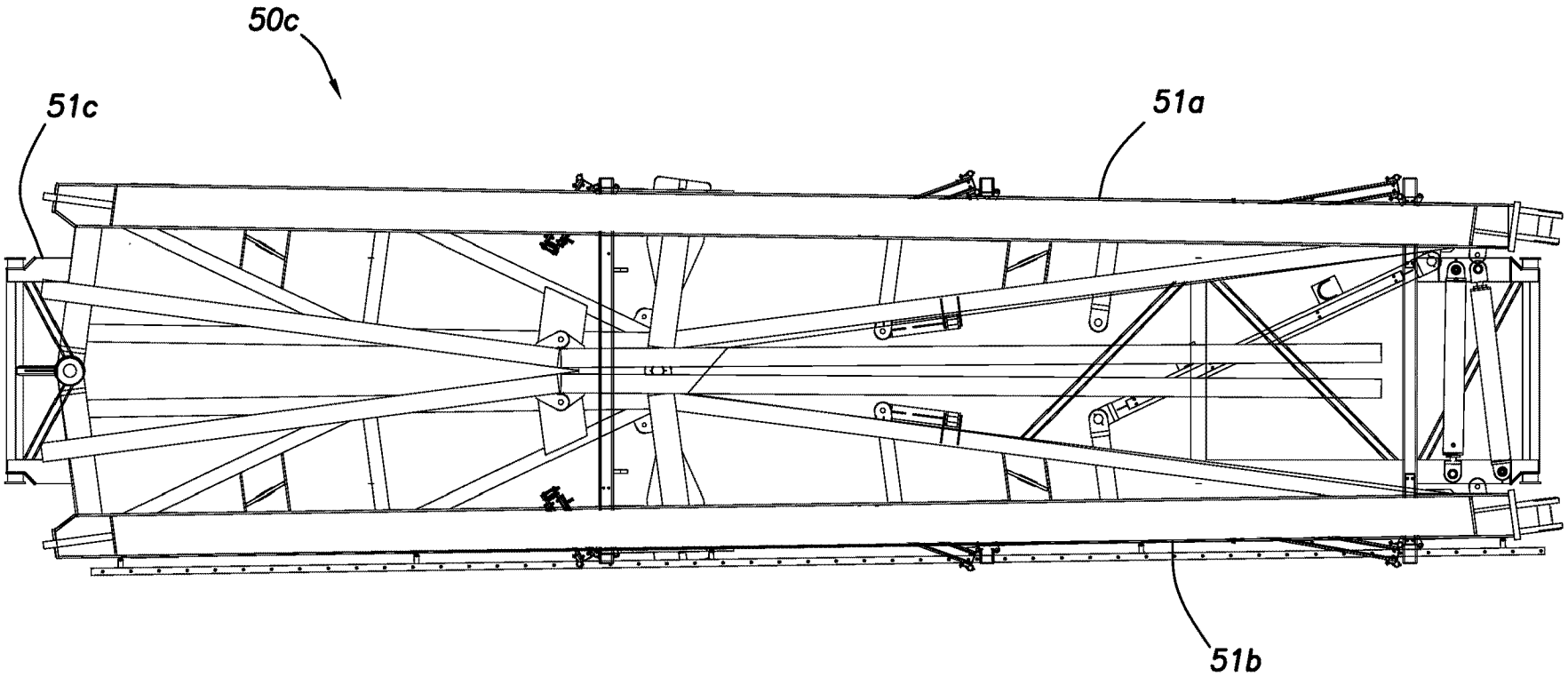
FIG. 9C depicts a top view of a lower mast subcomponent in a closed position.
Figure 9D:
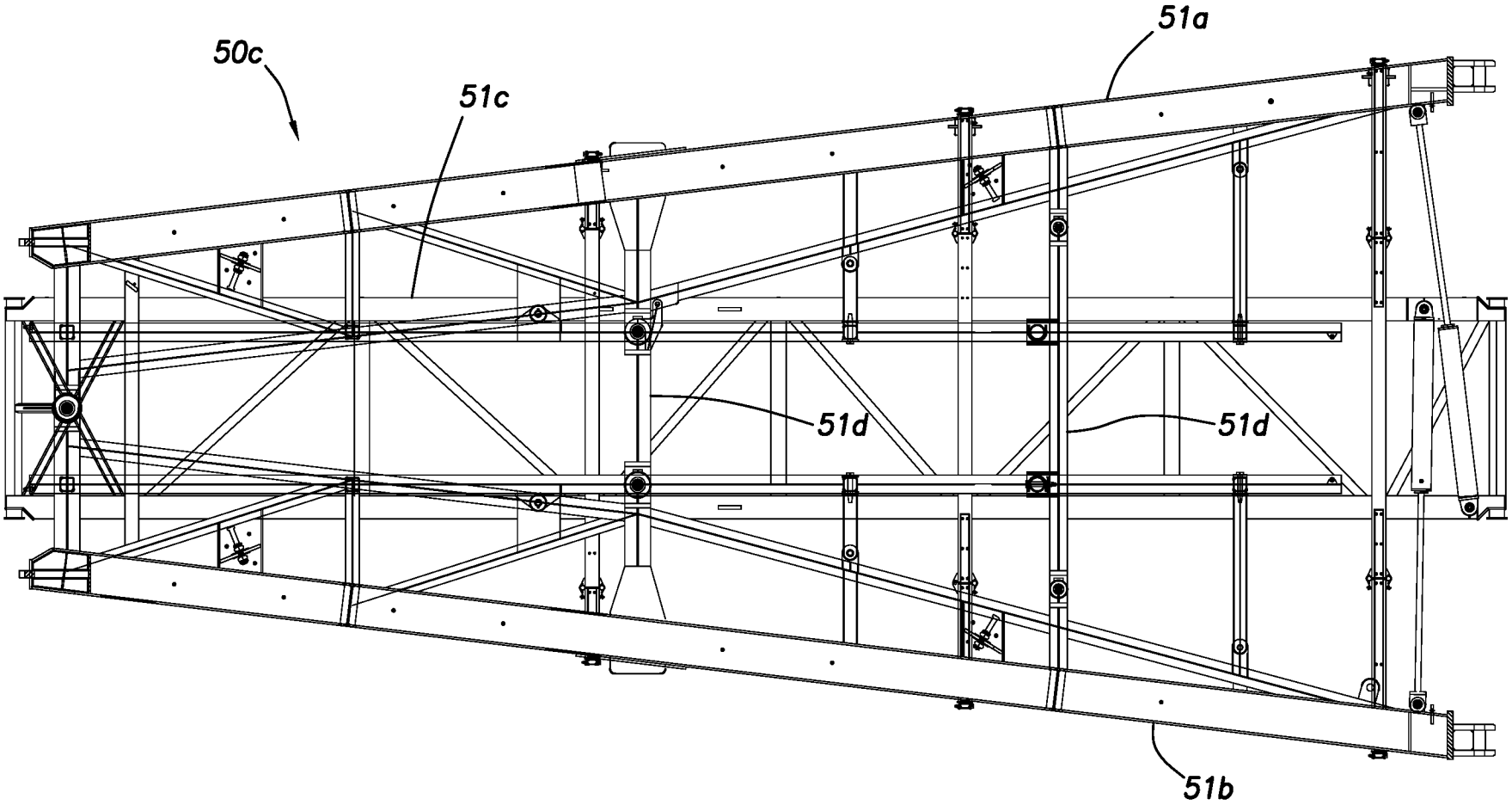
FIG. 9D depicts a top view of the lower mast subcomponent of FIG. 9C in an open position.

In some embodiments, as depicted in FIGS. 9C, 9D, lower mast subcomponent 50*c* may include mast lower extremities 51*a*, 51*b* and lower mast body 51*c*. Mast lower extremities 51*a* and 51*b* may be pivotably coupled to lower mast body 51*c* such that when in the horizontal position and for transportation, mast lower extremities 51*a* and 51*b* do not extend beyond the dimensions of lower mast body 51*c* as depicted in a retracted position in FIG. 9C. As depicted in FIG. 9D, mast lower extremities 51*a* and 51*b* may be pivoted outward into an extended position before mast 50 is mechanically coupled to drill rig floor 20. As depicted in FIG. 8, in some embodiments, one or more spreader beams 51*d* may be mechanically coupled between mast lower extremities 51*a* and 51*b* to, for example and without limitation, maintain the position of mast lower extremities 51*a* and 51*b*.

In some embodiments, as depicted in FIG. 7, left and right rig floor subunits 20*a*, 20*c* may include one or more drill floor cantilever beams 17. Drill floor cantilever beams 17 may be extended and may be used to support one or more pieces of drilling rig equipment including, for example and without limitation, driller's cabin skid 18 and choke house 19 as depicted in FIG. 8. Driller's cabin skid 18 and choke house 19 may move with drill rig floor 20 as drill rig floor 20 is raised. In some embodiments, drill floor cantilever beams 17 may be extended and receive driller's cabin skid 18 and choke house 19 after drill rig floor 20 is raised.

Figure 10:
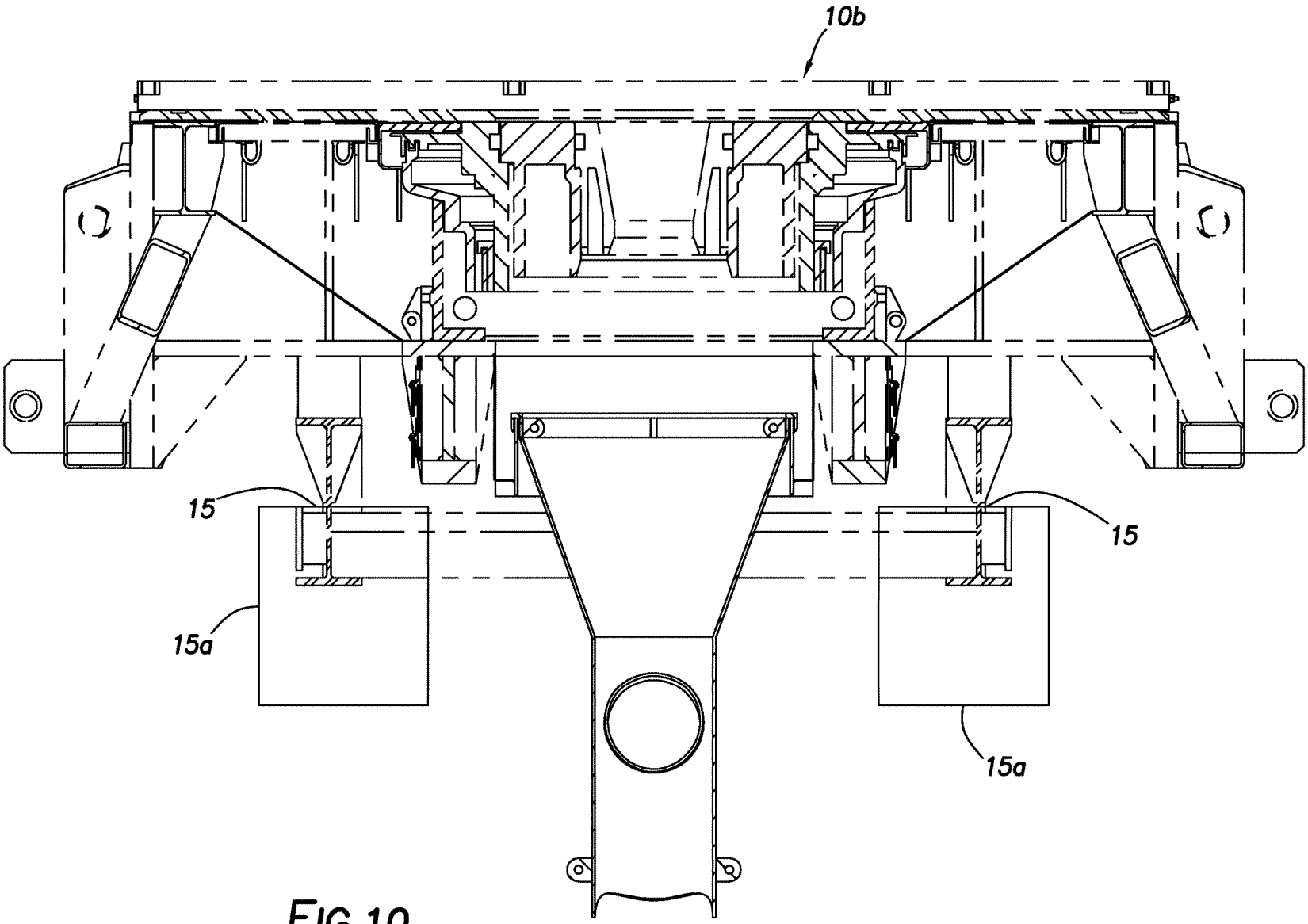
FIG. 10 depicts a cross section view of a drilling rig consistent with at least one embodiment of the present disclosure.

In some embodiments, as depicted from below in FIG. 10, center drilling rig subunit 10*b* may include support beams 15. In some embodiments, support beams 15 may be parallel or substantially parallel. In some embodiments, support beams 15 may, for example and without limitation, support the weight of center rig floor subunit 20*b*. In some embodiments, support beams 15 may be spaced apart a distance suitable for placement on a trailer. In some embodiments, when drilling rig 10 is in the raised position, support beams 15 may include one or more trolleys 15*a*. Trolleys 15*a* may roll along support beams 15, and may be used to hoist and move one or more components beneath drill rig floor 20. For example and without limitation, trolleys 15*a* may be used to hoist and move a blowout preventer or rotary control device (depicted as rotary control device 80 in FIG. 11).

Figure 11:
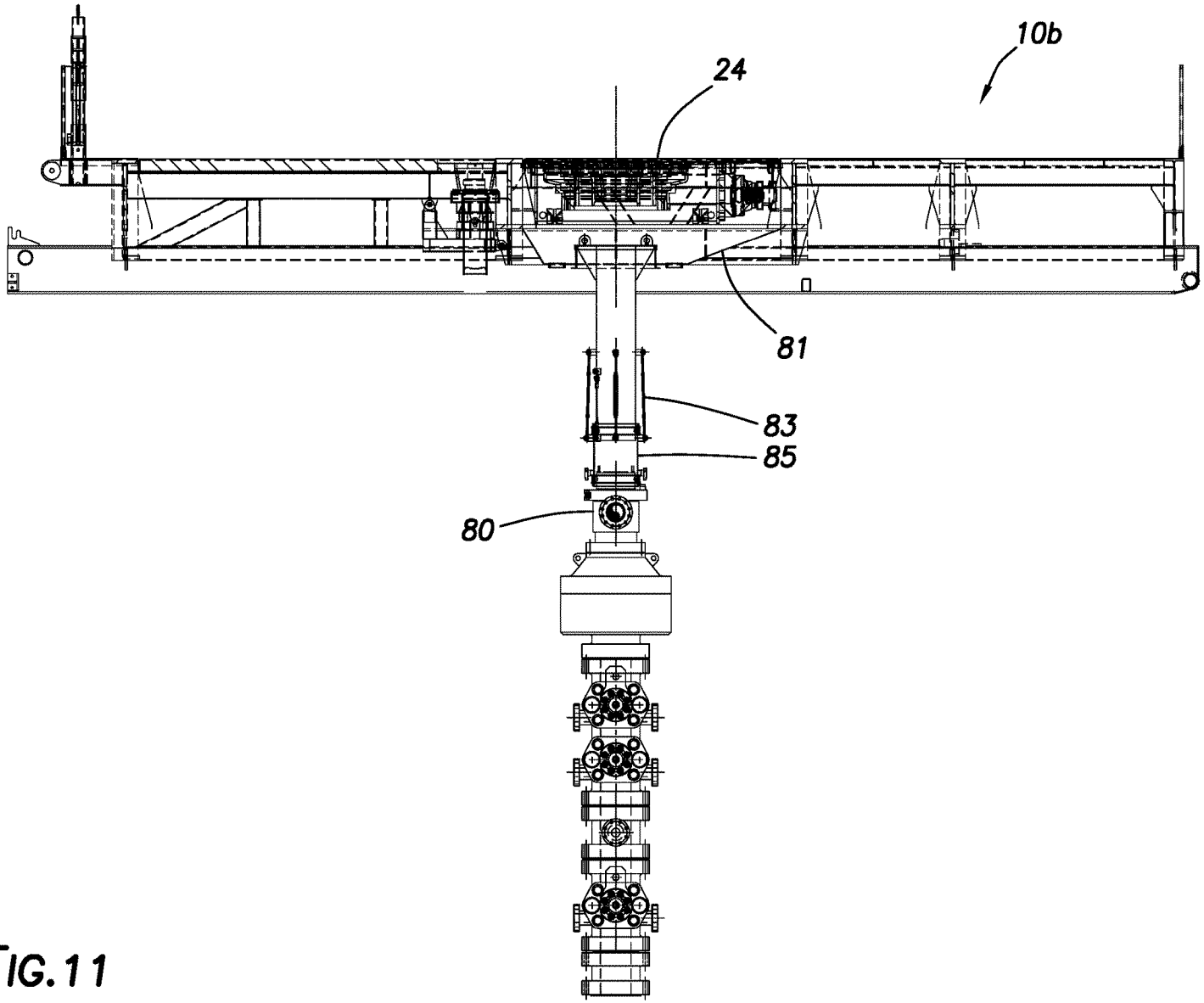
FIG. 11 depicts a cross section view of a drilling rig consistent with at least one embodiment of the present disclosure with a blowout preventer and rotary control device.

In some embodiments, as depicted in FIG. 11, center drilling rig subunit 10*b* may include catch basin 81. Catch basin 81 may be positioned beneath rotary table 24. In some embodiments, catch basin 81 may, for example and without limitation, collect fluid which flows through drill rig floor 20 at or around rotary table 24. In some embodiments, as depicted in FIG. 11, catch basin 81 may be mechanically coupled to containment riser 83. Containment riser 83 may extend between catch basin 81 and rotary control device 80. In some embodiments, containment riser 83 may collect fluid from catch basin 81 about a length of drill pipe (not shown). In some embodiments, containment riser 83 may include outlet 85, positioned to allow fluids within containment riser 83 to be removed from containment riser 83.

Figure 12:
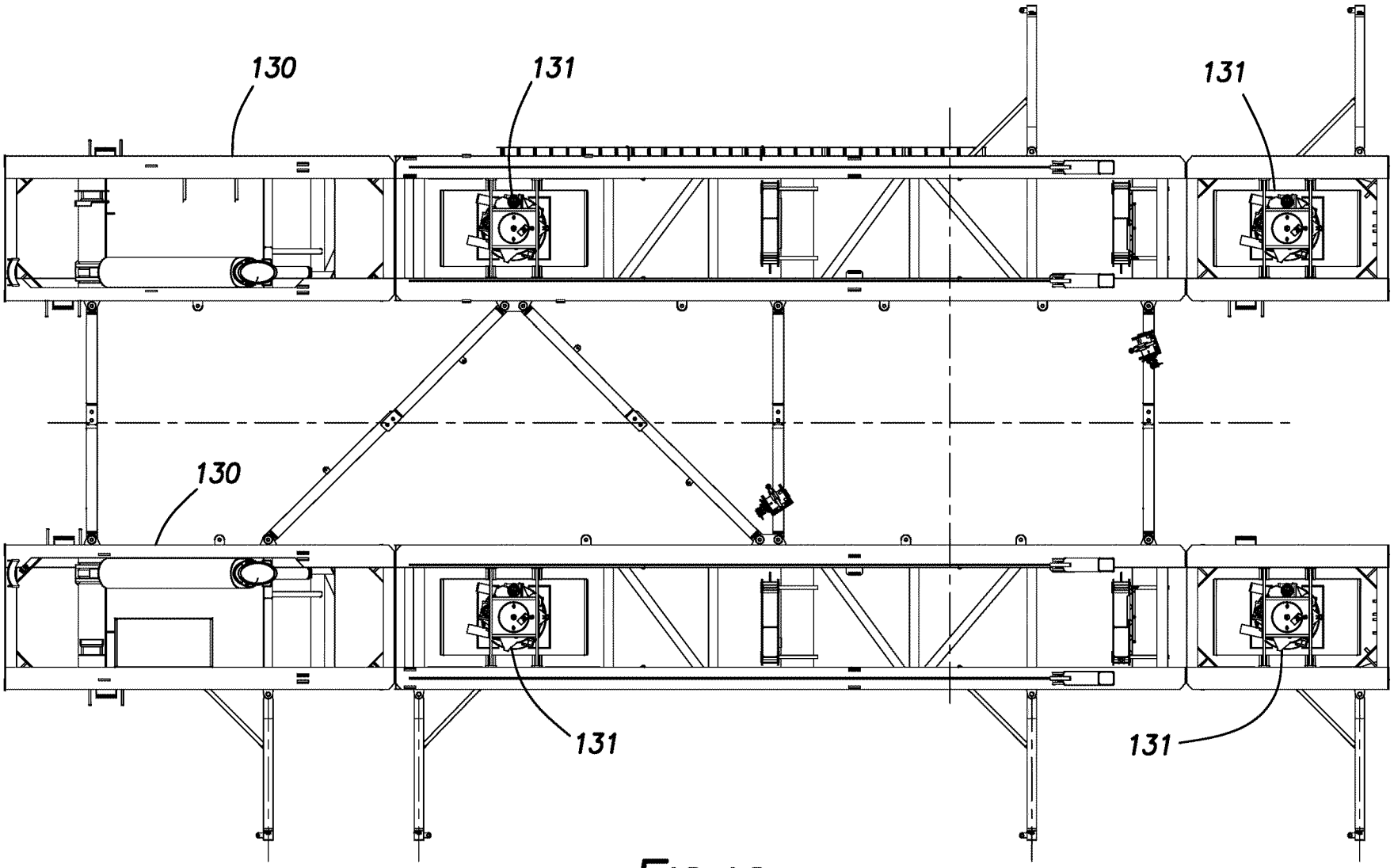
FIG. 12 depicts a partially transparent view of a drilling rig consistent with at least one embodiment of the present disclosure.

In some embodiments, one or more lower boxes 130 may include one or more hydraulic walkers 131 as depicted in FIG. 12. In some embodiments, hydraulic walkers 131 may be hydraulically actuatable to move or walk drilling rig 10 to a different location in the wellsite. In some embodiments, hydraulic walkers 131 may be operable to move or walk drilling rig 10 in any direction. In some embodiments, equipment positioned on equipment support cantilever beams 16 may be moved with drilling rig 10 as it is moved or walked. In some embodiments, the drilling rig may be skidded.

Figure 13:
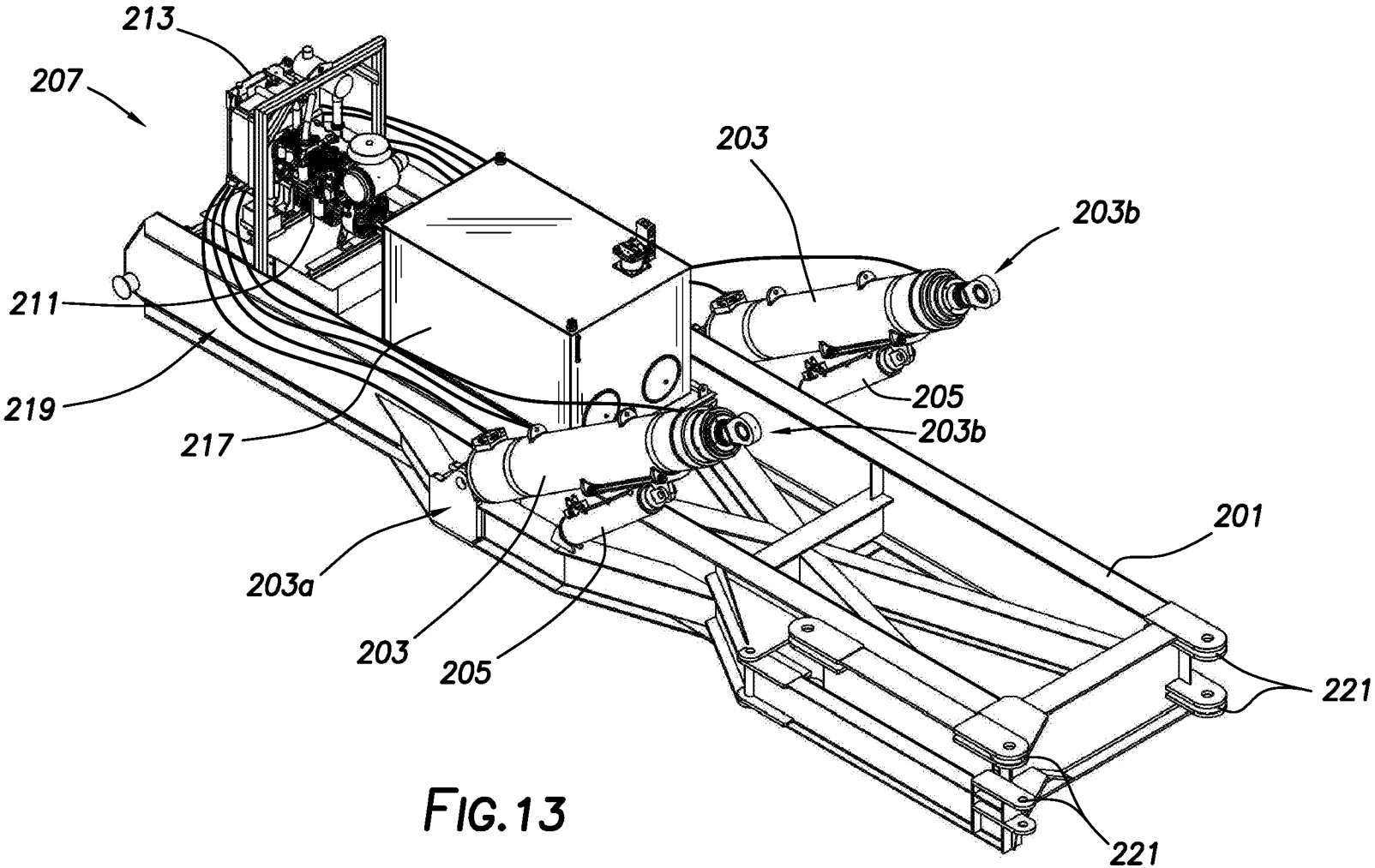
FIG. 13 depicts a hydraulic cylinder skid consistent with at least one embodiment of the present disclosure.
Figure 14:
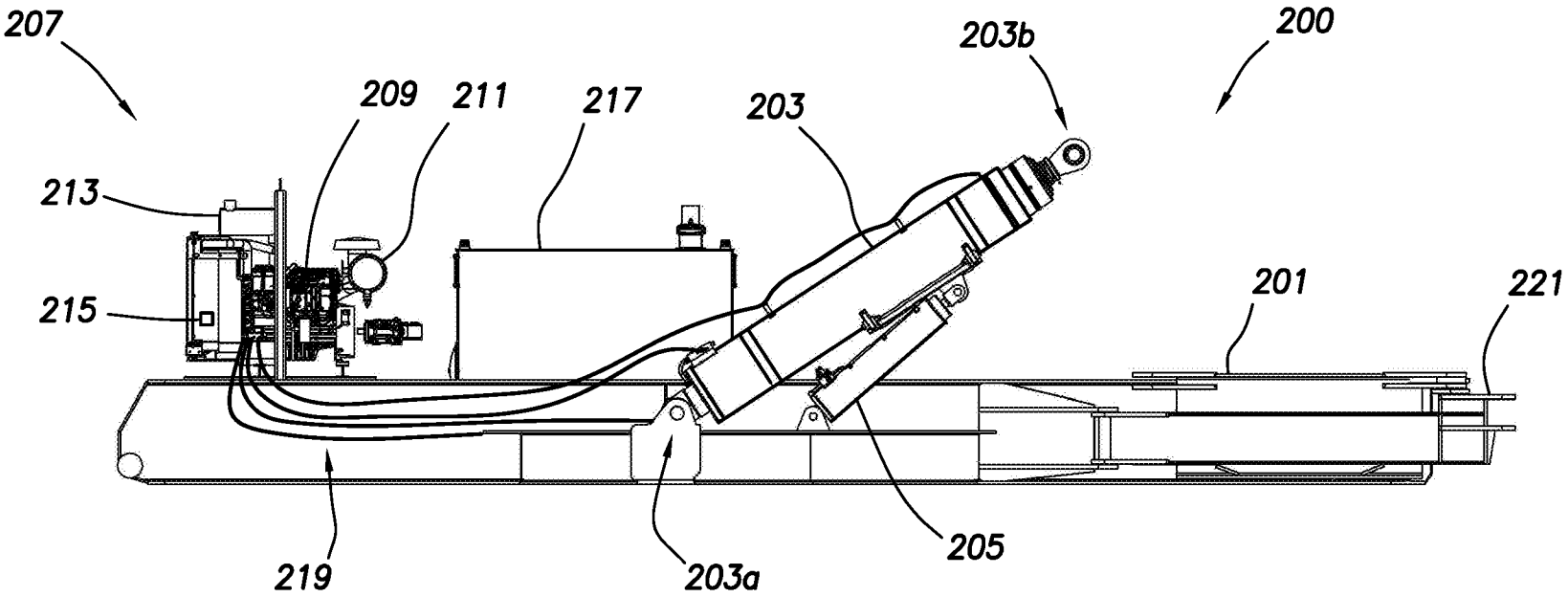
FIG. 14 is a side view of the hydraulic cylinder skid of FIG. 13.

FIGS. 13 and 14 depict hydraulic cylinder skid 200. Hydraulic cylinder skid 200 may include skid frame 201. Skid frame 201 may support other components of hydraulic cylinder skid 200 and allow for transportation of hydraulic cylinder skid 200 as a single unit. In some embodiments, hydraulic cylinder skid 200 may include one or more raising cylinders 203.

Raising cylinders 203 may be pivotably coupled to skid frame 201 at lower end 203*a* of raising cylinders 203. In some embodiments, hydraulic cylinder skid 200 may include cylinder positioning hydraulic cylinders 205. Each cylinder positioning hydraulic cylinder 205 may mechanically couple between skid frame 201 and a respective raising cylinder 203. Extension or retraction of cylinder positioning hydraulic cylinders 205 may allow the angle at which raising cylinders 203 extend from hydraulic cylinder skid 200 to be controlled. By modulating the extension of raising cylinders 203 and cylinder positioning hydraulic cylinders 205, upper end 203*b* of raising cylinders 203 may be positioned in space to, for example and without limitation, align with rig lift points 152, mast lift points 62 or any other desired position as described further herein below.

In some embodiments, hydraulic cylinder skid 200 may include hydraulic power unit 207. Hydraulic power unit 207 may be mechanically coupled to skid frame 201. Hydraulic power unit 207 may generate hydraulic pressure that may be used, for example and without limitation, to extend or retract raising cylinders 203 and cylinder positioning hydraulic cylinders 205. In some embodiments, hydraulic power unit 207 may include hydraulic pump 209. Hydraulic pump 209 may be used to pressurize hydraulic fluid. In some embodiments, hydraulic pump 209 may be powered mechanically by pump engine 211. Pump engine 211 may be, for example and without limitation, a combustion engine or electric motor.

In some embodiments, hydraulic power unit 207 may operatively couple to raising cylinders 203 and cylinder positioning hydraulic cylinders 205 through hydraulic cylinder skid controls 213. Hydraulic cylinder skid controls 213 may include one or more manifolds and valves positioned to control the flow of hydraulic fluid to raising cylinders 203 and cylinder positioning hydraulic cylinders 205 in order to control the extension or retraction of raising cylinders 203 and cylinder positioning hydraulic cylinders 205. In some embodiments, hydraulic cylinder skid controls 213 may be manually operated. In some embodiments, hydraulic cylinder skid controls 213 may be at least partially automated. In such an embodiment, hydraulic cylinder skid controls 213 may include programmable logic controller (PLC) 215 adapted to control the operation of raising cylinders 203 and cylinder positioning hydraulic cylinders 205.

In some embodiments, hydraulic cylinder skid 200 may include other components of a hydraulic system including, for example and without limitation, hydraulic reservoir 217 and hydraulic lines 219. In some embodiments, by including all components of a hydraulic system, hydraulic cylinder skid 200 may be transportable and usable without the need to disassemble or reassembly components of hydraulic cylinder skid 200.

In some embodiments, skid frame 201 may include rig attachment points 221. Rig attachment points 221 may be adapted to allow skid frame 201 to be mechanically coupled to a drilling rig in order to use raising cylinders 203 to interact with components of the drilling rig as discussed further below. Rig attachment points 221 may include, for example and without limitation, one or more holes that correspond to holes formed on the drilling rig to allow a pin-connection to be made to temporarily mechanically couple hydraulic cylinder skid 200 to the drilling rig.

Figure 15:
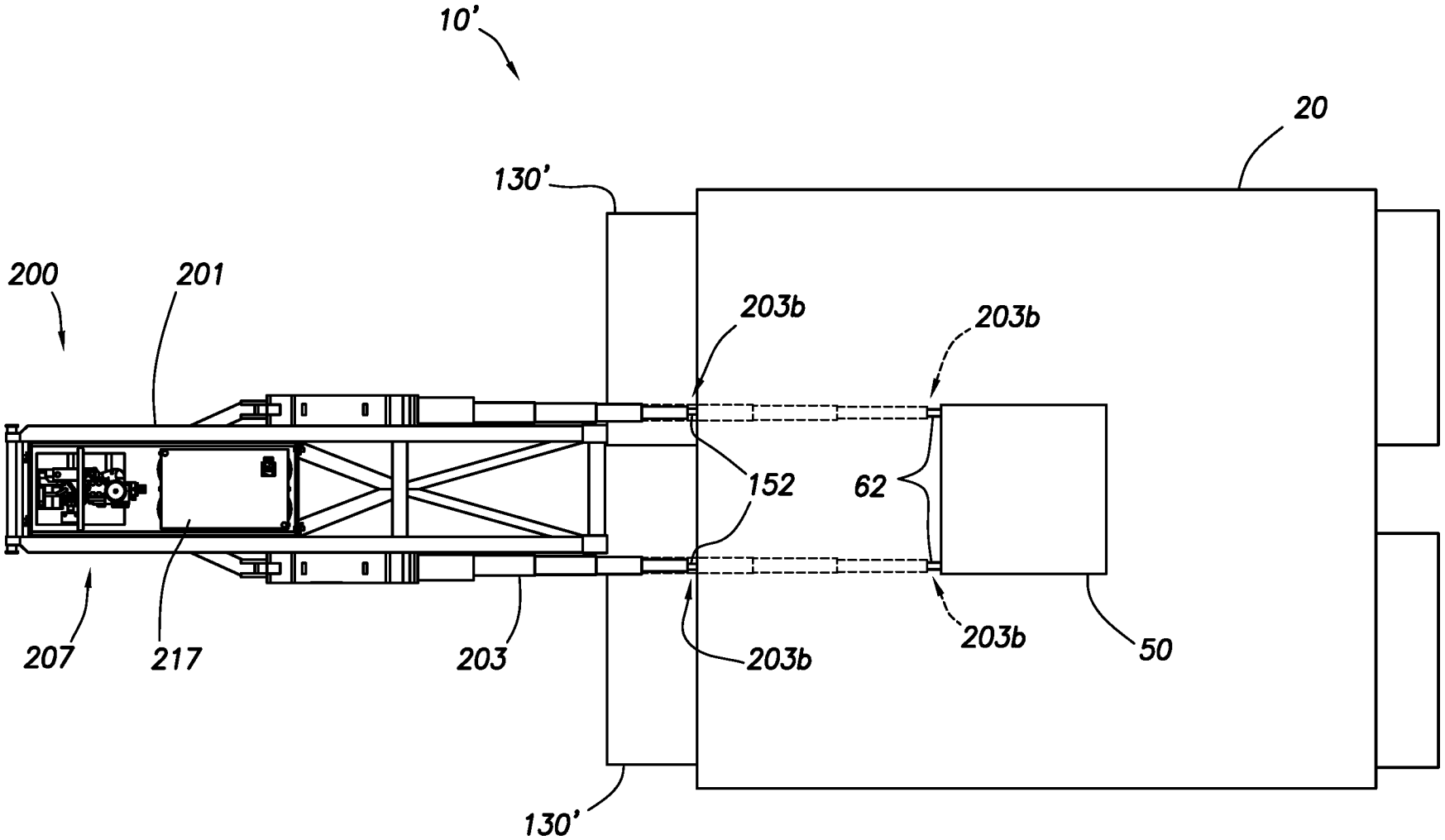
FIG. 15 depicts a top view of the drilling rig with an attached hydraulic cylinder skid consistent with at least one embodiment of the present disclosure.

For example, FIG. 15 depicts hydraulic cylinder skid 200 mechanically coupled to drilling rig 10'. In some embodiments, hydraulic cylinder skid 200 may be mechanically coupled to drilling rig 10' at an end of lower boxes 130' corresponding with the direction in which drill rig floor 20 moves when moved to the lowered position as discussed herein above. In some embodiments rig attachment points 221 may mechanically couple to corresponding attachment points formed on one or both of lower boxes 130'. In some embodiments, hydraulic cylinder skid 200 may be used to move drill rig floor 20 between the raised and the lowered position using raising cylinders 203 substantially as described with respect to hydraulic cylinders 150 as described herein above. For example, in some embodiments, upper end 203*b* of raising cylinders 203 may mechanically couple to one or more corresponding rig lift points 152 of drill rig floor 20. Raising cylinders 203 may then be extended to move drill rig floor 20 from the lowered position to the raised position, or may be retracted to move drill rig floor 20 from the raised position to the lowered position. Once drill rig floor is in the desired position, raising cylinders 203 may be decoupled from rig lift points 152.

In some embodiments, hydraulic cylinder skid 200 may be used to move mast 50 between the raised and lowered positions while mechanically coupled to drilling rig 10' at an end of lower boxes 130'. In such an embodiment, upper end 203*b* of raising cylinders 203 may mechanically couple to one or more corresponding mast lift points 62 of mast 50. Raising cylinders 203 may then be extended to move mast 50 from the lowered position to the raised position, or may be retracted to move mast 50 from the raised position to the lowered position. Once mast 50 is in the desired position, raising cylinders 203 may be decoupled from mast lift points 62.

One having ordinary skill in the art with the benefit of this disclosure will understand that the present disclosure does not limit the order of raising or lowering of mast 50 and drill rig floor 20.

Once drill rig floor 20 and mast 50 are in the desired raised or lowered positions, upper end 203*b* of raising cylinders 203 may be mechanically decoupled from rig lift points 152 and mast lift points 62, raising cylinders 203 may be fully retracted for storage, and hydraulic cylinder skid 200 may be mechanically decoupled from drilling rig 10'. During operation or transportation of drilling rig 10', hydraulic cylinder skid 200 needs not remain mechanically coupled to drilling rig 10'. In some embodiments, hydraulic cylinder skid 200 may be removed from drilling rig 10' to, for example and without limitation, reduce the weight of, footprint of, and number of components carried by drilling rig 10' during operation or transportation of drilling rig 10'. In some embodiments, hydraulic cylinder skid 200 may be transported to a second drilling rig on the same or another wellsite to raise or lower the respective drill floor or mast of the second drilling rig.

In some embodiments, because hydraulic cylinder skid 200 includes raising cylinders 203, cylinder positioning hydraulic cylinders 205, hydraulic power unit 207, hydraulic pump 209, pump engine 211, hydraulic cylinder skid controls 213, hydraulic reservoir 217, and hydraulic lines 219 all mechanically coupled to skid frame 201, hydraulic cylinder skid 200 may be transported as a single unit without the need to disconnect any operative couplings between the components of hydraulic cylinder skid 200. In some embodiments, such as where pump engine 211 is a combustion engine, hydraulic cylinder skid 200 may operate independently without any additional connections to external equipment required.

Although described with respect to drilling rig 10' as described herein, one having ordinary skill in the art with the benefit of this disclosure will understand that hydraulic cylinder skid 200 may be used with any drilling rig with a pivoting drilling floor, pivoting mast, or both, including, for example and without limitation, a sidesaddle drilling rig The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A method comprising:

transporting a drilling rig to a wellsite, the drilling rig including a drill rig floor and a lower box, the drill rig floor in a lowered position;

pivotably coupling a mast to the drill rig floor, the mast in a horizontal position;

mechanically coupling a hydraulic cylinder skid to the drilling rig, the hydraulic cylinder skid adapted to be separately movable from the drilling rig, the hydraulic cylinder skid positioned at an end of the lower box when mechanically coupled to the drilling rig;

mechanically coupling a raising cylinder of the hydraulic cylinder skid to the mast;

extending the raising cylinder to move the mast from the horizontal position to a vertical position;

mechanically coupling the raising cylinder to the drill rig floor; and extending the raising cylinder to move the drill rig floor from the lowered position to a raised position.

2. The method of claim 1, wherein the hydraulic cylinder skid further comprises a skid frame, the skid frame having a rig attachment point, wherein mechanically coupling the hydraulic cylinder skid to the drilling rig comprises coupling the skid frame to the drilling rig at the rig attachment point.

3. The method of claim 2, wherein the hydraulic cylinder skid further comprises at least one cylinder positioning hydraulic cylinder and wherein the method further comprises controlling the angle between the skid frame and the raising cylinder using the cylinder positioning hydraulic cylinder.

4. The method of claim 1, wherein mechanically coupling the raising cylinder to the mast comprises mechanically coupling the raising cylinder to a corresponding mast lift point of the mast.

5. The method of claim 1, wherein mechanically coupling the raising cylinder to the drill rig floor comprises mechanically coupling the raising cylinder to a corresponding rig lift point of the drill rig floor.

6. The method of claim 1, wherein the mast comprises a traveling block and a top drive positioned within the mast while the mast is moved from the horizontal position to the vertical position.

7. The method of claim 1, wherein the mast comprises an upper mast subcomponent, a middle mast subcomponent, and a lower mast subcomponent, and the method further comprises mechanically coupling the upper, middle, and lower mast subcomponents.

8. The method of claim 7, wherein the lower mast subcomponent comprises a lower mast body and two lower extremities, the lower extremities pivotably coupled to the lower mast body, and the method further comprises moving the lower extremities into an extended position before mechanically coupling to the drill rig floor.

9. The method of claim 1 further comprising moving the mast from the vertical position to the horizontal position.

10. The method of claim 9, wherein the step of moving the mast comprises:

retracting the raising cylinder; and decoupling the raising cylinder from the mast lift point of the mast.

11. The method of claim 1 further comprising:

moving the drill rig floor from a raised position to a lowered position.

12. The method of claim 11, wherein the step of moving the drill rig floor from a raised position to a lowered position comprises:

retracting the raising cylinder; and decoupling the raising cylinders from the rig lift point.

13. The method of claim 1 further comprising decoupling the hydraulic cylinder skid from the drilling rig.

* * * * *